US007882583B2

(12) United States Patent
Skripps

(10) Patent No.: US 7,882,583 B2
(45) Date of Patent: Feb. 8, 2011

(54) HEAD SUPPORT APPARATUS FOR SPINAL SURGERY

(75) Inventor: Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 182 days.

(21) Appl. No.: 11/402,332

(22) Filed: Apr. 11, 2006

(65) Prior Publication Data

US 2006/0253985 A1 Nov. 16, 2006

Related U.S. Application Data

(63) Continuation-in-part of application No. 11/229,759, filed on Sep. 19, 2005.

(60) Provisional application No. 60/626,627, filed on Nov. 10, 2004, provisional application No. 60/670,027, filed on Apr. 11, 2005, provisional application No. 60/670,040, filed on Apr. 11, 2005, provisional application No. 60/670,041, filed on Apr. 11, 2005, provisional application No. 60/720,598, filed on Sep. 26, 2005.

(51) Int. Cl.
*A61G 13/12* (2006.01)

(52) U.S. Cl. ..... 5/621

(58) Field of Classification Search ..... 6/621–624, 6/637; 5/621–624, 637; 24/455, 459; 248/316.1, 248/6, 229.14; 108/27–28
See application file for complete search history.

(56) References Cited

U.S. PATENT DOCUMENTS

| | | | | |
|---|---|---|---|---|
| 933,471 | A | 9/1909 | Leahy | |
| 2,452,816 | A | 11/1948 | Wagner | |
| 2,509,086 | A | 5/1950 | Eaton | |
| 2,688,142 | A | 9/1954 | Jensen | |
| 3,042,025 | A | 7/1962 | Jackson | |
| 3,099,441 | A | 7/1963 | Ries | |
| 3,188,079 | A * | 6/1965 | Boetcker et al. | 5/622 |
| 3,572,835 | A | 3/1971 | Kees, Jr. et al. | |
| 3,828,377 | A | 8/1974 | Fary, Sr. | |
| 3,897,777 | A | 8/1975 | Morrison | |

(Continued)

FOREIGN PATENT DOCUMENTS

WO 2005/020819 A1 3/2005

OTHER PUBLICATIONS

2005 Catalog Passionate About Positioning, Allen Medical Systems, A Hill-Rom Company; ©; date Dec. 2004.

*Primary Examiner*—Fredrick Conley
(74) *Attorney, Agent, or Firm*—Barnes & Thornburg LLP

(57) ABSTRACT

An apparatus comprises a base configured to mount on a frame, a post coupled to the base and extending upwardly therefrom, a head support for supporting the head of a patient lying in a prone position on the frame, and a lockable joint coupled to the post and coupled to the head support to position the head support above the base. The lockable joint, when locked, prevents movement of the head support along the post and prevents movement of the head support relative to the post about a plurality of axes. The lockable joint, when unlocked, allows movement of the head support along the post and allows movement of the head support relative to the post about the plurality of axes.

47 Claims, 18 Drawing Sheets

U.S. PATENT DOCUMENTS 3,947,686 A 3/1976 Cooper et al.
3,957,262 A 5/1976 McReynolds
4,018,412 A 4/1977 Kees, Jr. et al.
4,033,339 A 7/1977 Roberts et al.
4,034,748 A 7/1977 Winner
4,054,282 A 10/1977 Hamer
4,108,426 A 8/1978 Lindstroem et al.
4,139,917 A 2/1979 Fenwick
4,169,478 A 10/1979 Hickmann
4,225,125 A 9/1980 Lee
4,243,025 A 1/1981 Jones
4,378,108 A 3/1983 Bailey, Jr.
D271,834 S 12/1983 Huntsinger
4,474,364 A 10/1984 Brendgord
4,484,911 A 11/1984 Berlin et al.
4,504,050 A 3/1985 Osborne
4,526,355 A 7/1985 Moore et al.
4,545,572 A 10/1985 Day
4,620,697 A 11/1986 Pithon
4,671,728 A 6/1987 Clark et al.
4,752,064 A 6/1988 Voss
4,757,983 A 7/1988 Ray et al.
4,823,776 A 4/1989 Foster et al.
4,840,363 A 6/1989 McConnell
4,852,840 A 8/1989 Marks
4,865,484 A 9/1989 McConnell
4,923,187 A 5/1990 Mombrinie
4,979,519 A 12/1990 Chavarria et al.
4,989,848 A 2/1991 Monroe
4,995,067 A 2/1991 Royster et al.
5,081,665 A 1/1992 Kostich
5,088,706 A 2/1992 Jackson
5,131,106 A 7/1992 Jackson
5,207,716 A 5/1993 McReynolds et al.
5,214,815 A 6/1993 Agbodoe et al.
5,220,699 A 6/1993 Farris
5,233,713 A 8/1993 Murphy et al.
5,269,035 A 12/1993 Hartunian
5,276,927 A 1/1994 Day
5,317,771 A 6/1994 Cook
5,408,713 A * 4/1995 Stratton et al. ..... 5/632
5,427,436 A 6/1995 Lloyd
5,444,882 A 8/1995 Andrews et al.
5,515,867 A 5/1996 Lamb
5,520,623 A 5/1996 Williams
5,524,639 A 6/1996 Lanier et al.
5,531,229 A 7/1996 Dean et al.
5,564,663 A * 10/1996 Cook et al. ..... 248/222.12
5,569,175 A 10/1996 Chitwood
5,613,254 A 3/1997 Clayman et al.
5,613,501 A 3/1997 Michelson
5,615,432 A 4/1997 Von Ohlen, III
5,642,302 A 6/1997 Dumont et al.
5,661,859 A 9/1997 Schaefer
5,741,210 A 4/1998 Dobrovolny
5,758,374 A 6/1998 Ronci
5,916,189 A 6/1999 Sullenperger et al.
5,926,876 A 7/1999 Haigh et al.
D414,974 S 10/1999 Marrone, II et al.
5,960,494 A 10/1999 Gilliland et al.
6,065,165 A 5/2000 Delk et al.
6,076,208 A 6/2000 Heimbrock et al.
6,108,840 A 8/2000 Heimbrock et al.
6,112,333 A 9/2000 Mazzei
6,120,397 A 9/2000 Julian
6,138,302 A 10/2000 Sashin et al.
6,138,304 A 10/2000 Lipsky et al.
6,151,734 A 11/2000 Lawrie
6,154,903 A 12/2000 Wai-Chung
6,199,552 B1 3/2001 Crespo
6,202,230 B1 3/2001 Borders
6,249,923 B1 6/2001 Heimbrock et al.
6,260,220 B1 7/2001 Lamb et al.
6,276,012 B2 8/2001 Borders
6,374,439 B2 4/2002 Heimbrock et al.
6,397,414 B1 6/2002 Lloyd
6,427,273 B1 * 8/2002 Berke et al. ..... 5/657
6,442,777 B1 9/2002 Pauli
6,446,287 B2 9/2002 Borders
6,490,737 B1 * 12/2002 Mazzei et al. ..... 2/410
6,510,852 B1 1/2003 Shiery et al.
6,532,609 B2 3/2003 Taylor et al.
6,557,195 B2 * 5/2003 Dinkler ..... 5/601
6,561,194 B2 5/2003 Michelson
6,564,406 B2 5/2003 VanSteenburg et al.
6,578,215 B1 6/2003 Heimbrock et al.
6,594,839 B1 7/2003 Papay
6,622,324 B2 9/2003 VanSteenburg et al.
6,637,058 B1 10/2003 Lamb
6,701,553 B1 3/2004 Hand et al.
6,739,006 B2 5/2004 Newkirk et al.
6,754,923 B2 6/2004 Borders et al.
D497,430 S * 10/2004 Tinsley ..... D24/184
7,017,211 B2 3/2006 Krywiczanin et al.
7,089,613 B2 8/2006 Cohen
7,117,551 B1 * 10/2006 Dinkler et al. ..... 5/637
2002/0061225 A1 5/2002 Boucher et al.
2004/0123389 A1 7/2004 Boucher et al.

* cited by examiner

HEAD SUPPORT APPARATUS FOR SPINAL SURGERY

CROSS REFERENCE TO RELATED APPLICATIONS

This application claims the benefit, under 35 U.S.C. §119 (e), of U.S. Provisional Patent Application Nos. 60/670,027, 60/670,040, and 60/670,041 all three of which were filed Apr. 11, 2005; and of U.S. Provisional Patent Application No. 60/720,598 which was filed Sep. 26, 2005. This application is also a continuation-in-part of U.S. application Ser. No. 11/229,759 which was filed Sep. 19, 2005 and which claimed the benefit, under 35 U.S.C. §119(e), of U.S. Provisional Patent Application No. 60/626,627 which was filed Nov. 10, 2004. U.S. Provisional Application Nos. 60/670,027; 60/670,040; 60/670,041; 60/720,598 and U.S. application Ser. No. 11/229,759 are hereby expressly incorporated by reference herein.

BACKGROUND OF THE INVENTION

The present disclosure generally relates to surgical tables, and particularly to surgical tables for spinal surgery. More particularly, the present disclosure relates to an apparatus for supporting a patient's head during spinal surgery.

Positioning of a patient is an important consideration in spinal surgery. A patient undergoing spinal surgery must be properly positioned in a prone position to provide the surgeon adequate access to a surgical site. Some known surgical tables are usable for spinal surgeries, such as a surgical table shown in U.S. Pat. No. 5,131,106 and a surgical table extension shown in U.S. Pat. No. 4,995,067. U.S. Pat. Nos. 5,131,106 and 4,995,067 are hereby incorporated by reference herein.

SUMMARY OF THE INVENTION

The present invention comprises an apparatus having one or more of the features recited in the claims or one or more of the following features, which alone or in any combination may comprise patentable subject matter:

A head support apparatus may comprise a base configured to mount on the frame, a post coupled to the base and extending upwardly therefrom, a head support for supporting the head of a patient lying in a prone position on the frame, and a lockable joint coupled to the post and coupled to the head support to position the head support above the base. The lockable joint, when locked, may prevent movement of the head support along the post and may prevent movement of the head support relative to the post about a plurality of axes. The lockable joint, when unlocked, may allow movement of the head support along the post and may allow movement of the head support relative to the post about the plurality of axes.

At least the base and the head support may be formed of radiolucent material. The lockable joint may include a housing movable along the post and a handle coupled to the housing and configured to lock the housing at a selected longitudinal position along the post and lock the lockable joint against movement about the plurality of axes. The handle may be movable between a first position in which the lockable joint is locked and a second position in which the lockable joint is unlocked. The handle may be removably coupled to the housing. A tether may support the handle when the handle is not coupled to the housing. The lockable joint may comprise a ball joint. The lockable joint may comprise a modular support configured to be coupled to each of a plurality of head supports. As used herein, the term "head support" broadly includes skull clamps, head rings, forehead supports, horseshoe headrests, and the like.

The base may include a pair of longitudinally-extending and transversely-spaced side portions and a cross portion extending transversely between the side portions. The side portions may define a space below the head support which is substantially free of any structure that would interfere with the caregiver having relatively unrestricted access to the mouth, the nose and the eyes of a patient lying in a prone position. A mirror may be coupled to the cross portion below the head support for movement between a use position adjacent a patient's face and a storage position away from the patient's face. A friction mechanism may be coupled to the mirror and coupled to the cross portion of the base to maintain the mirror at a selected angular position.

A lockable second joint may be coupled to the cross portion and coupled to the post. The lockable second joint, when locked, may prevent lateral movement of the post along the cross portion. The lockable second joint, when unlocked, may allow lateral movement of the post along the cross portion. The lockable second joint may include a mounting block having a downwardly-facing channel sized to receive the cross portion and a handle coupled to the mounting block and configured to lock the mounting block at a selected transverse position along the cross portion.

The head support may comprise a shell having an upwardly-facing concave interior surface and a chin support coupled to a pair of laterally-spaced arms that extend outwardly from a downwardly-facing surface of the shell. The shell may have a cutout in communication with an opening formed by the chin support and the laterally-spaced arms to allow one or more tubes, such as an endotracheal tube, to be routed therethrough to a patient's nose and/or mouth. The arms may be located below the upwardly-facing surface of the shell to define a space above the arms through which one or more tubes may be routed to a patient's nose and/or mouth. The shell may be molded from a plastic material, and the cutout may be integrally molded therewith.

In some embodiments, a head support apparatus may comprise a head support including a shell having a chin pad and a foam pad having a downwardly-opening recess configured to receive the chin pad when the head support supports the head of a patient lying in a prone position with the foam pad interposed between the shell and the patient's face. The shell may have a pair of posts that extend downwardly from a downwardly-facing surface of the shell, and the foam pad may have a pair of laterally-spaced tabs that are configured to attach to the posts.

In some other embodiments, a head support apparatus may comprise a head support including a shell having an upwardly-facing concave interior surface and a relatively flat foam pad that moves from a flat state into a curved state as it moves down into the shell under the weight of a patient's head. The shell and the flat foam pad may each have a cutout in a region thereof that corresponds to a patient's eyes, nose and mouth. The side walls of the cutout in the foam pad may flare outwardly away from a patient's face as the foam pad moves into the curved state under the weight of a patient's head. The foam pad may be made from water-based polyurethane foam.

In still other embodiments, a head support apparatus may comprise a base configured to mount on a frame, an inclined plane coupled to the base and a foam block having a downwardly-facing surface configured to engage an upwardly-facing surface of the inclined plane. The inclined plane and the foam block may each have a cutout in a region thereof that corresponds to a patient's eyes, nose and mouth.

In some embodiments, a head support apparatus may comprise a base configured to mount on the frame, a vertically adjustable post coupled to the base and extending generally upwardly therefrom, a relatively shallow dish coupled to the post and a foam block having a downwardly-facing surface configured to engage an upwardly-facing surface of the dish. The foam block and the dish may each have a cutout in a region thereof corresponding to a patient's eyes, nose and mouth.

In other embodiments, a head support apparatus may comprise a base configured to mount on the frame, a U-shaped support coupled to the base and extending generally upwardly therefrom and a foam block coupled to a bight portion of the U-shaped support for pivoting movement about a transverse axis. The foam block and the dish may each have a cutout in a region thereof corresponding to a patient's eyes, nose and mouth.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the following figures, in which.

DETAILED DESCRIPTION OF THE DRAWINGS

Figure 1:
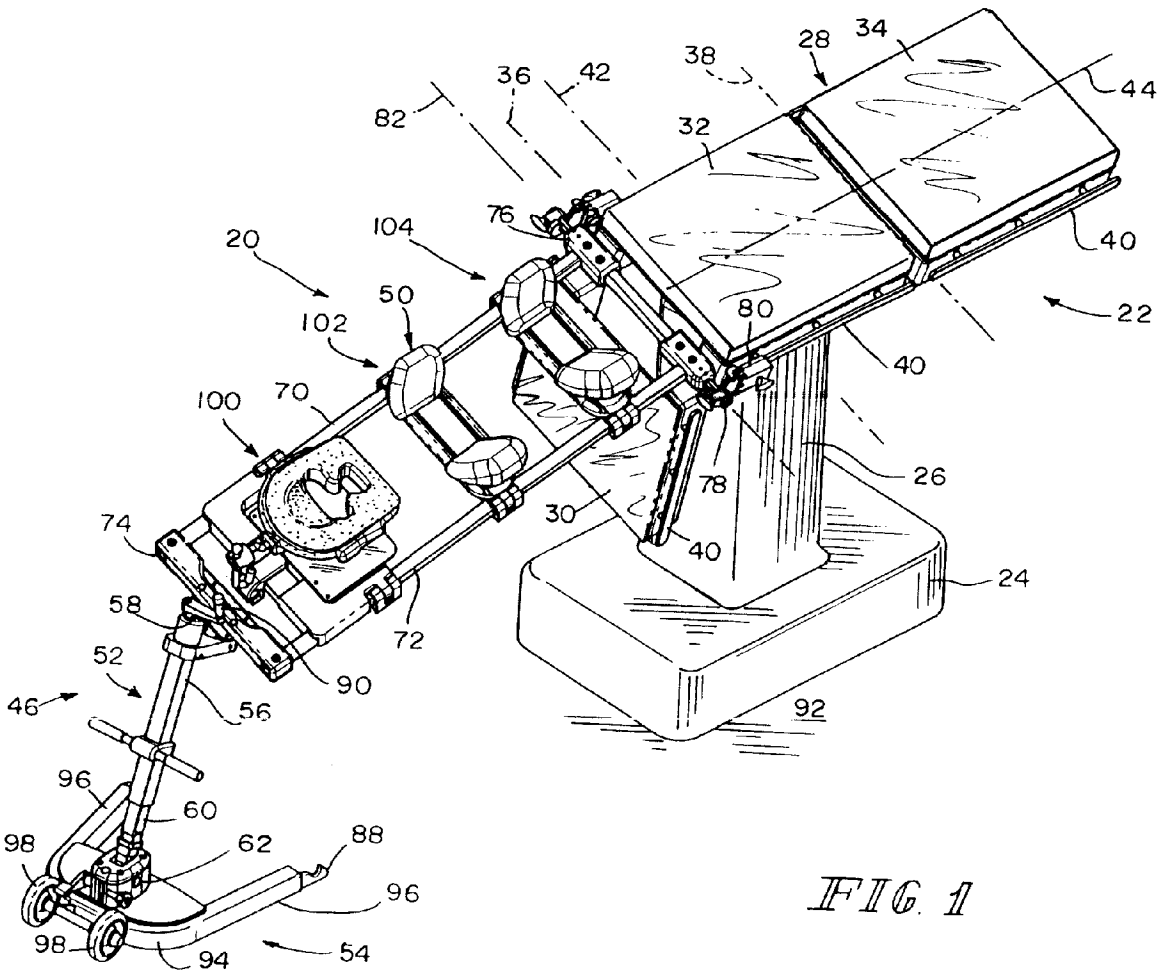
FIG. 1 is a perspective view of a spinal surgery extension having one end coupled to a surgical table and having the other end supported by an adjustable telescopic support showing the spinal surgery extension having a pair of laterally-spaced siderails to which head, chest and hip supports are removably secured.

As shown in FIG. 1, a spinal surgery extension 20 is coupled to a surgical table 22. Illustratively, the surgical table 22 has a base 24, a pedestal 26, and a patient support deck 28. The deck 28 includes a head section 30, a seat section 32, and a foot section 34. The head and foot sections 30, 34 are pivotably coupled to the seat section 32 about respective transverse axes 36, 38. Each deck section 30, 32, 34 includes two utility or accessory rails 40 on opposite sides thereof. The deck 28 is pivotable about a transverse axis 42 between Trendelenberg and reverse-Trendelenberg positions. In addition, the deck 28 is pivotable about a longitudinal axis 44. In FIG. 1, the head section 30 is pivoted downwardly to an out-of-the-way position so that the spinal surgery extension 20 can be attached to a head end 46 of the surgical table 22.

The spinal surgery extension 20 includes a generally rectangular frame 50, an adjustable telescopic support 52, and a generally U-shaped base 54. An upper end 56 of the telescopic support 52 is coupled to the frame 50 by an upper multi-axes joint 58 and a lower end 60 of the telescopic support 52 is coupled to the base 54 by a lower multi-axes joint 62. In the illustrated embodiment, the upper joint 58 is a universal joint and the lower joint 62 is a ball joint. The rectangular frame 50 includes left and right longitudinally-extending transversely-spaced siderails 70, 72 and head and foot end cross rails 74, 76 extending transversely between the siderails 70, 72 near head and foot ends of the frame 50. The head end cross rail 74 is coupled to the telescopic support 52 via the upper joint 58. Two pivot shafts 78 extend outwardly from foot end cross rail 76. The pivot shafts 78 are supported by associated rail clamps 80 secured to the accessory rails 40 of the seat section 32 of the surgical table 22. The pivot shafts 78 allow the frame 50 to pivot about a transverse axis 82 relative to the surgical table 22.

The siderails 70, 72 and the cross rails 74, 76 of the frame 50 have a generally rectangular cross section. In the illustrated embodiment, the rails 70, 72, 74, 76 are each about 1.5 inches (about 3.81 centimeters) high and about 1.25 inches (about 3.175 centimeters) wide. The inside spacing between the siderails 70, 72 is about 14.5 inches (about 36.83 centimeters). The inside spacing between the cross rails 74, 76 is about 48.5 inches (about 123.2 centimeters). The rails 70, 72, 74, 76 are made from radiolucent material, such as carbon fiber tube with a foam core, so that they do not interfere with x-ray imaging of a patient supported in a prone position on the frame 50 during spinal surgery. For certain surgical procedures, such as spinal surgery, it is desirable to have x-ray images of the patient to guide the surgeon in performing the surgery.

The telescopic support 52 includes a crank handle 90 which is operable to vary the height of the head end of the frame 50 between about 30 inches (about 76.2 centimeters) and about 42 inches (about 106.68 centimeters) above a floor 92. The U-shaped base 54 includes a bight portion 94 and two spaced legs 96 which flare outwardly. When the frame 50 is attached to the surgical table 22, the legs 96 extend toward the surgical table as shown in FIG. 1. Two wheels 98 are coupled to the bight portion 94 such that the wheels 98 are spaced from the floor when the legs 96 are resting on the floor 92. Each leg 96 has a hook 88 at its free end. For storage, the frame 50 is detached from the surgical table 22 and folded downwardly so that the pivot shafts 78 are received in the respective hooks 88. The telescopic support 52 is extended by turning the crank 90, thereby firmly securing the pivot shafts 78 to the hooks 88. The extension 20 can be tilted so that wheels 98 engage the floor 92 and the assembly can then be rolled along the floor 92.

As shown in FIG. 1, head, chest and hip support apparatuses 100, 102, 104 are coupled to the frame 50 for supporting a patient in a prone position during spinal surgery. The head support apparatus 100 supports the head of a patient lying in a prone position during spinal surgery. Likewise, the chest and hip support apparatuses 102, 104 support the chest and the hips of the patient lying in a prone position during spinal surgery. In use, the upper body of a patient lying in a prone position is supported on the head, chest and hip support apparatuses 100, 102, 104 attached to the frame 50, with at least portions of the legs of the patient supported on the surgical table 22 to which the extension 20 is coupled. The pivotable coupling of the foot end of the frame 50 to the surgical table 20, the pivotable coupling of the head end of the frame 50 to the telescopic support 52 and the pivotable coupling of the telescopic support 52 to the base 54 allow articulation of the table 22 within a range of movement without creating undue stresses and/or bending moments in the extension 20 and/or the table 22.

The chest and hip support apparatuses 102, 104 are described in detail in U.S. patent application Ser. No. 11/402,327, entitled "Body Support Apparatus for Spinal Surgery," and filed concurrently herewith, which is hereby incorporated by reference herein. The spinal surgery extension 20 is described in detail in U.S. patent application Ser. No. 11/402,330, entitled "Accessory Frame for Spinal Surgery," and filed concurrently herewith, which is also hereby incorporated by reference herein.

Figure 2:
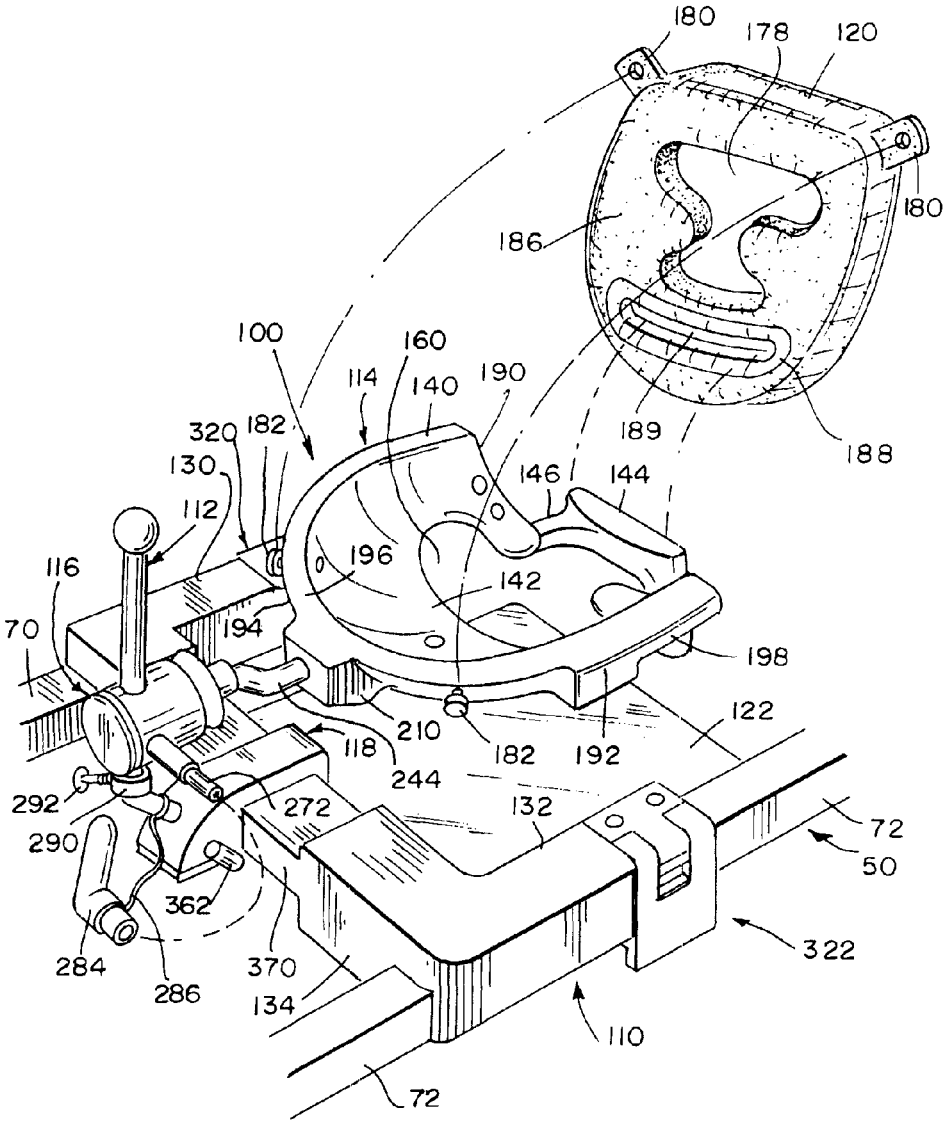
FIG. 2 is an enlarged perspective view of the head support showing a C-shaped base removably secured to the siderails, a post extending forwardly and upwardly from the base, a head support, a lockable upper joint coupled to the post and coupled to the head support, a contoured foam pad positioned above the head support, a removable handle coupled to the post by a tether, a lockable lower joint coupled to the base and coupled to the post, and a mirror (in phantom) pivotably coupled a cross portion of the base.
Figure 12:
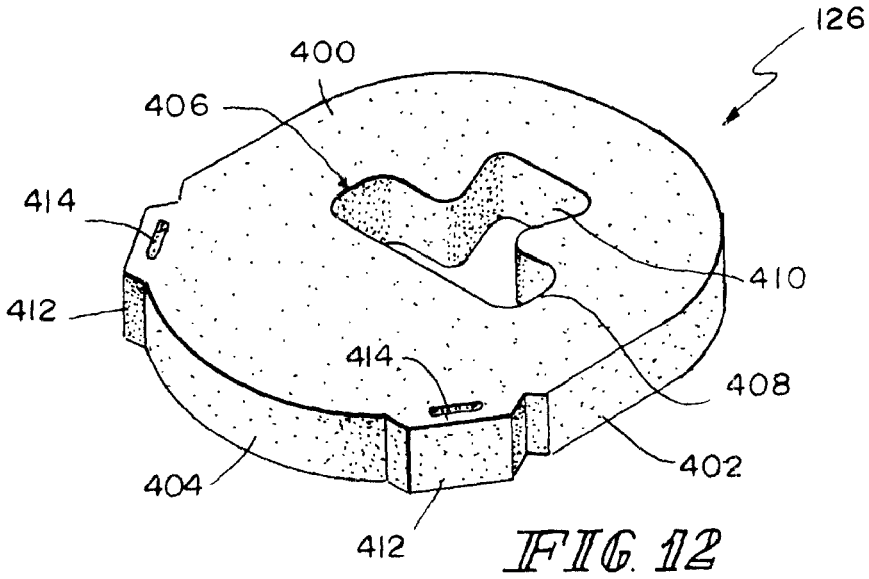
FIG. 12 is a perspective view showing a relatively flat foam pad.
Figure 13:
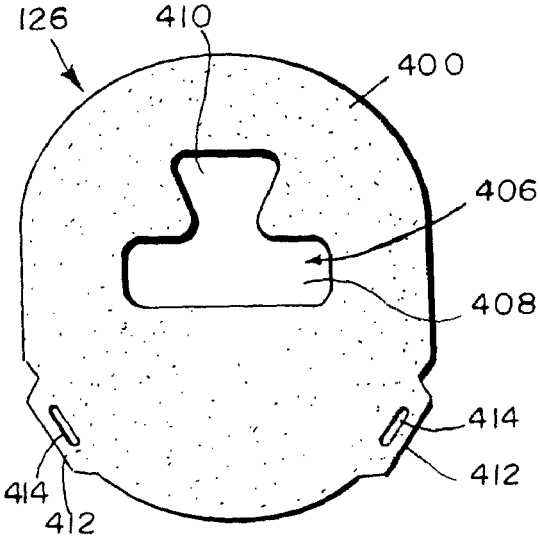
FIGS. 13 and 14 are plan and side elevational views of the foam pad of FIG. 12, FIGS. 15-31 disclose other embodiments of the head support apparatus.
Figure 14:
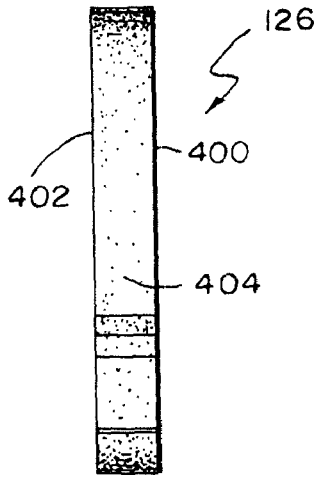

As shown in FIG. 2, the head support apparatus 100 includes a generally C-shaped base 110 configured to mount on the frame 50, a post 112 coupled to the base 110 and extending forwardly and upwardly therefrom, a head support 114 for supporting the head of a patient lying in a prone position during spinal surgery, and a lockable upper joint 116 coupled to the post 112 and coupled to the head support 114 to position the head support 114 above the base 110 in a spaced-apart relationship. The head support 114 is made from a relatively rigid radiolucent plastic material, such as polyethylene. To reduce the risk of injuries to a patient's face caused by the weight of the patient's own head, a cushion, such as a contoured foam pad 120 shown in FIG. 2, is interposed between the patient's face and the head support 114. The contoured foam pad 120 is made from cosmetic foam, such as water-based polyurethane foam. FIGS. 12-14 show a relatively thin flat foam pad 126 which may be substituted for the foam pad 120.

The lockable joint 116, when locked, prevents vertical movement of the head support 114 along the post 112 and prevents movement of the head support 114 relative to the post 112 about a plurality of axes. As used herein, the term "plurality of axes" means at least two axes. The lockable joint 116, when unlocked, allows vertical movement of the head support 114 along the post 112 and allows movement of the head support 114 relative to the post 112 about a plurality of axes. Thus, the lockable joint 116, when unlocked, may allow movement of the head support 114 relative to the post 112 about two axes, three axes, and so on. Further, as used herein, the term "spinal surgery" is used in a general sense to mean any back surgery, including the spinal surgery, in which a patient is supported in a prone position with the patient's head supported by the head support 114.

Figure 6:
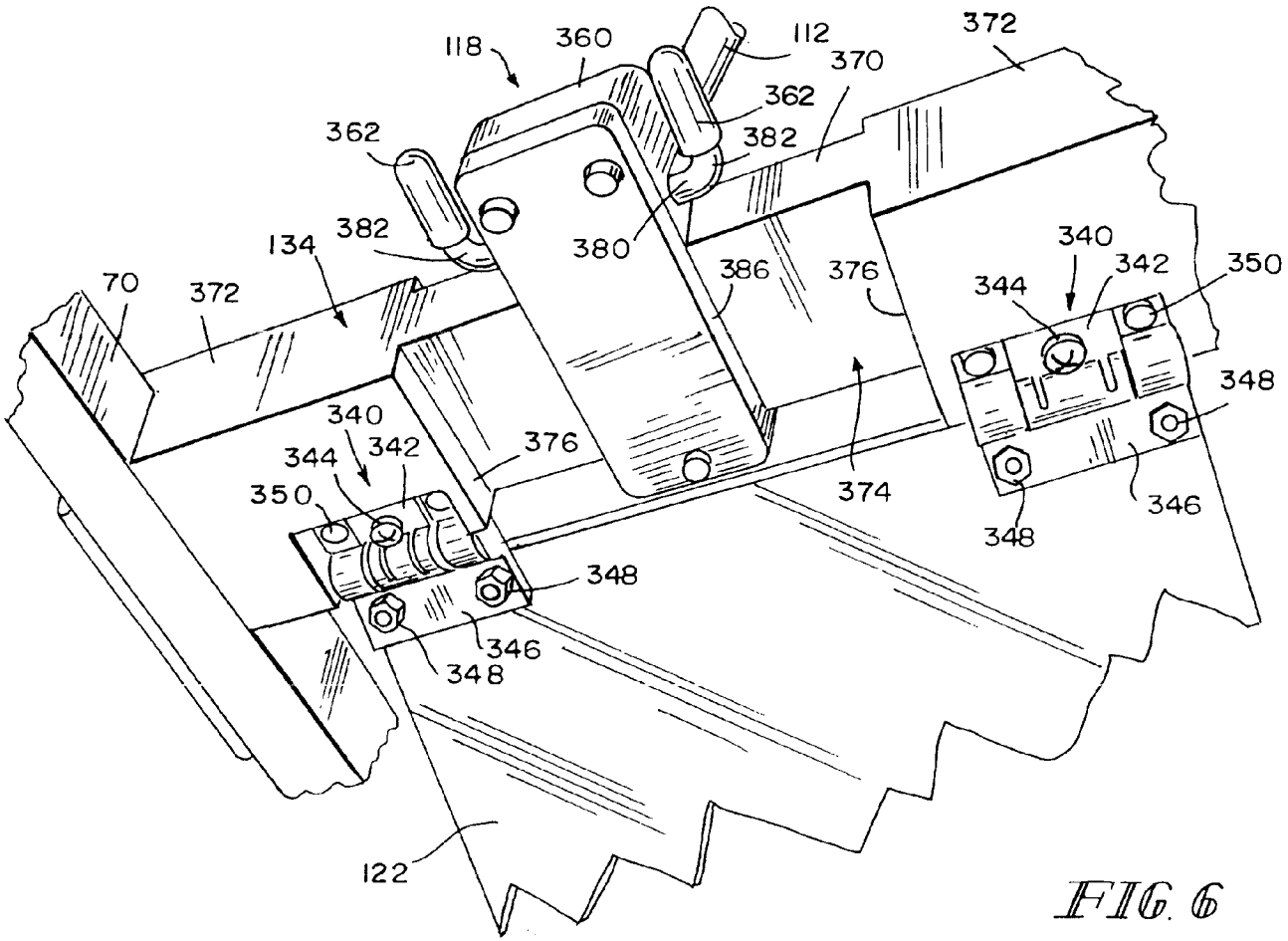
FIG. 6 is a bottom perspective view of the head support apparatus showing the base, a pair of hinges pivotably coupling the mirror to the base, and a U-shaped handle coupled to the lockable lower joint.
Figure 9:
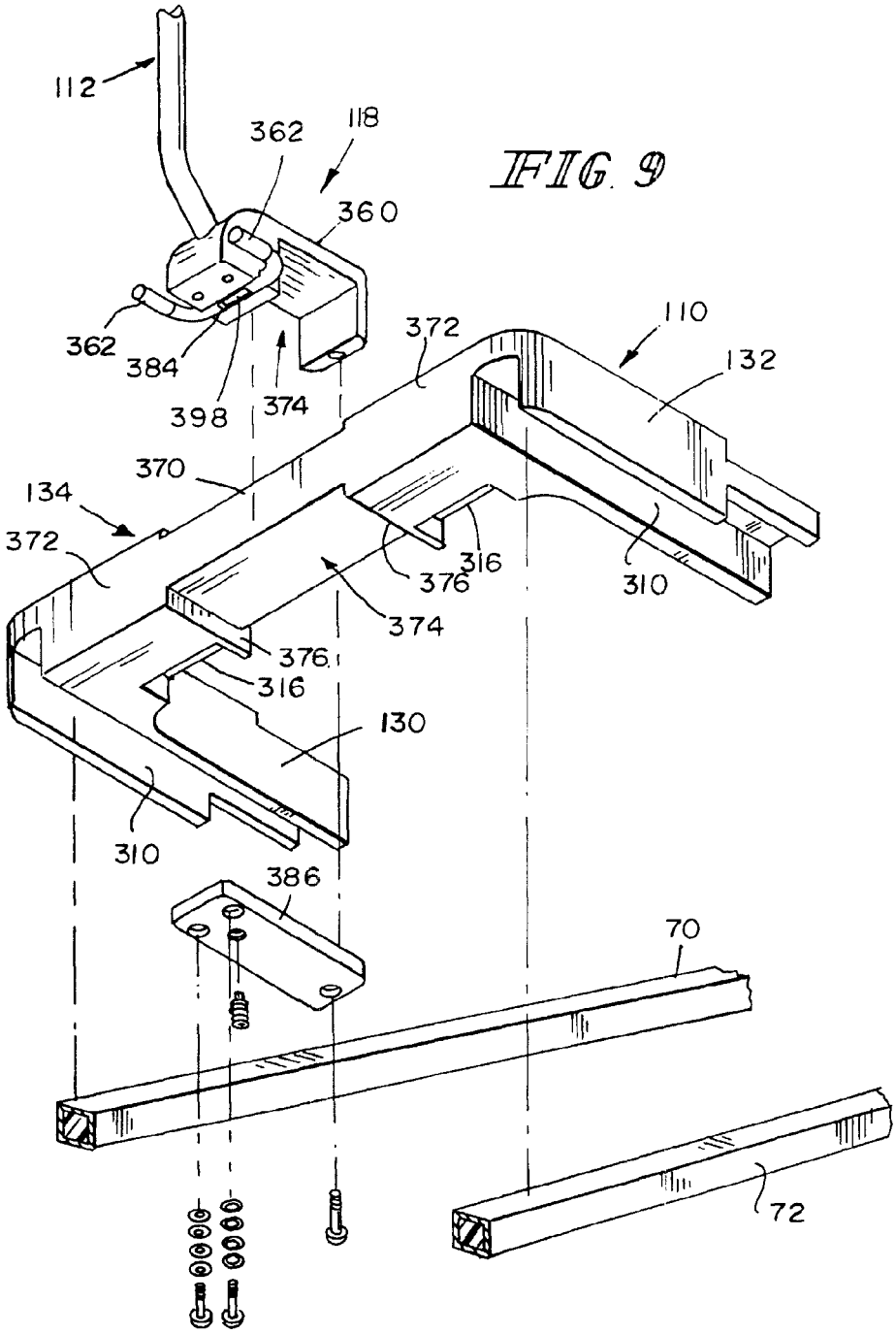
FIG. 9 is a bottom perspective view showing the C-shaped base having a pair of laterally-spaced side portions and a cross portion transversely extending between the side portions, the side portions having downwardly-opening channels for receiving the siderails of the spinal surgery extension, a block having a downwardly-opening channel for receiving the cross portion of the base, the block having a downwardly-opening slot for receiving a bight portion of the U-shaped handle, a cover plate configured to be secured to the underside of the block, and the post extending forwardly and upwardly from the block.

In the illustrated embodiment, as shown, for example, in FIG. 9, the base 110 includes a pair of longitudinally-extending and transversely-spaced side portions 130, 132 and a cross portion 134 extending transversely between the side portions 130, 132. The side portions 130, 132 and the cross portion 134 define a space below the head support 114 which is substantially free of any structure that would interfere with the caregiver having relatively unrestricted access to the mouth, the nose and the eyes of a patient lying in a prone position with the patient's head supported by the head support. As shown in FIG. 6, a mirror 122 is coupled to the cross portion 134 below the head support 114 for pivoting movement about a generally transversely-extending axis 124 between a storage position (shown in phantom in FIG. 4) away from a patient's face and a use position (shown in solid in FIG. 4) adjacent the patient's face so that a caregiver can view the patient's mouth, nose and eyes in the mirror 122. In the illustrated embodiment, the base 110 is about 10 inches (about 25.4 centimeters) long, about 17.75 inches (about 45.085 centimeters) wide, and about 2 inches (about 5.08 centimeters) high. Although, the illustrated base 110 has a C-shaped configuration in plan view, it may very well have a different configuration in plan view, such as an H-configuration. In the illustrated embodiment, the base 110 is made from radiolucent material, such as ABS plastic.

Figure 7:
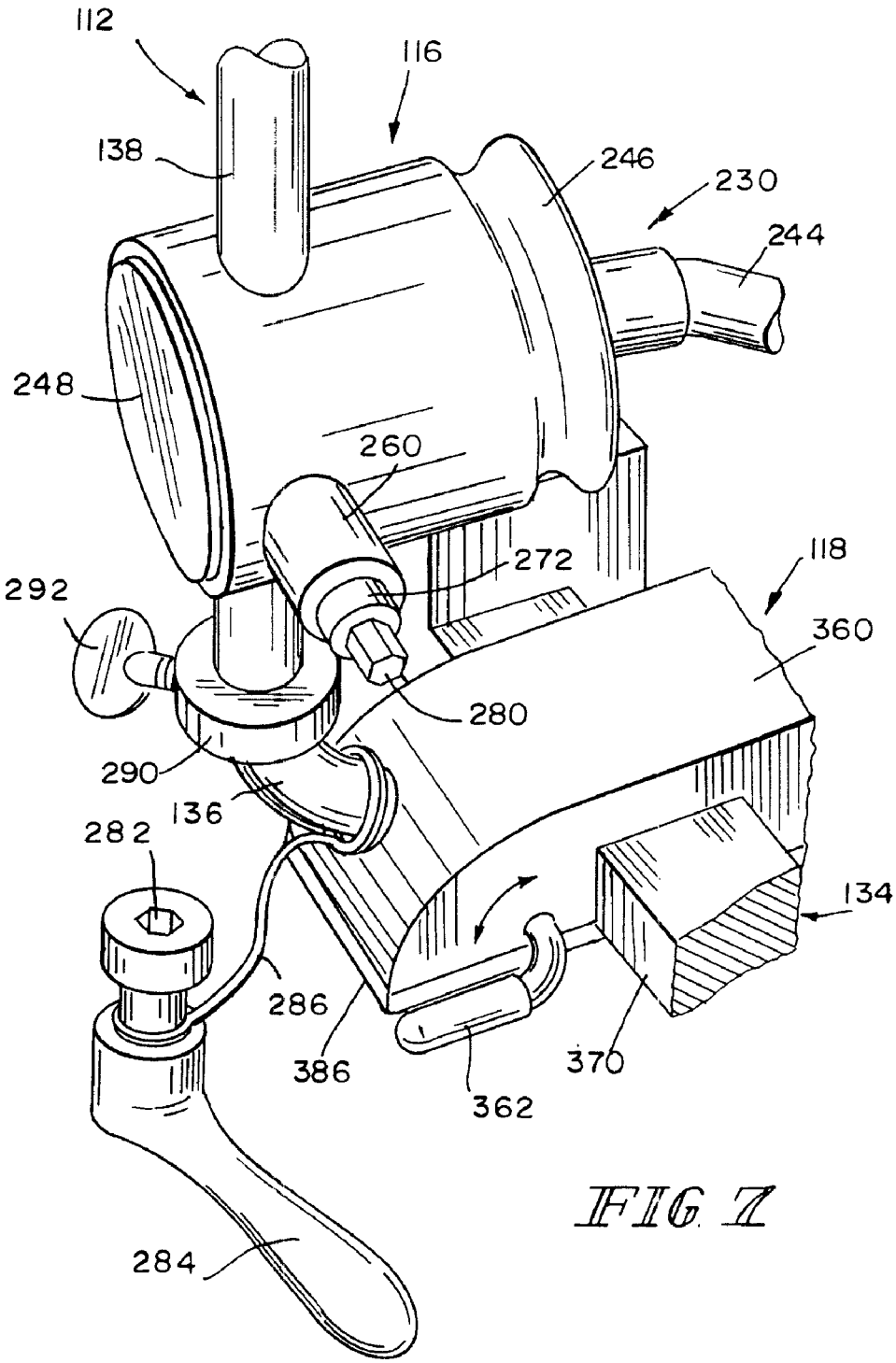
FIG. 7 is an enlarged perspective view showing the lockable upper joint having a housing, a threaded shaft having a hex head extending outwardly from the housing, and the handle having a hex socket coupled to the post by the tether.

As shown in FIG. 2, the head support apparatus 100 includes a lockable lower joint 118 coupled to the cross portion 134 and coupled to the post 112. The lockable joint 118, when locked, prevents lateral movement of the post 112 along the cross portion 134, and the lockable joint 118, when unlocked, allows lateral movement of the post 112 along the cross portion 134. In the illustrated embodiment, as shown in FIG. 7, the post 112 has a first portion 136 that extends forwardly and upwardly from the lockable joint 118 and a second portion 138 that extends upwardly from the first portion 136. In the illustrated embodiment, the post 112 has a diameter of about 0.625 inches (about 1.5875 centimeters) and a height of about 9.0 inches (about 22.86 centimeters). The post 112 is made of stainless steel. As used herein, the terms "transverse" and "lateral" are used interchangeably, and each term is intended to have the broad meanings of both.

Figure 3:
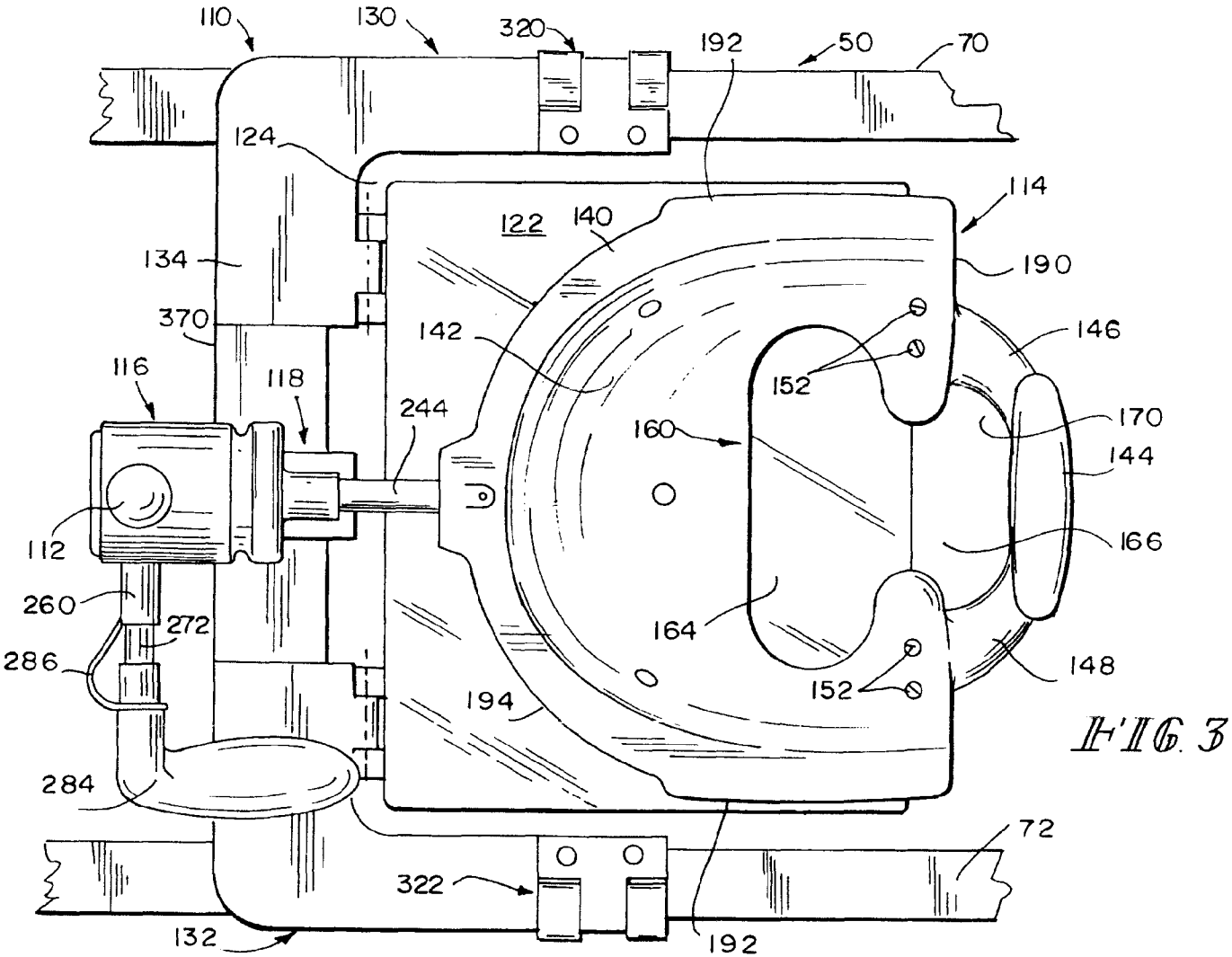
FIG. 3 is a plan view of the head support apparatus.

Referring to FIGS. 2-5 in general and FIG. 3 in particular, the head support 114 includes a cradle or shell 140 having an upwardly-facing generally concave interior surface 142 dimensioned to accommodate the facial structure of a patient resting in a prone position and a chin pad or support 144 coupled the shell 140 by a pair of laterally-spaced side arms 146, 148. As used herein, the phrase "patient lying or resting in a prone position" means patient lying or resting in a prone position with the patient's head supported by the head support 114. In the illustrated embodiment, the side arms 146, 148 are each attached to a downwardly-facing surface 150 (FIG. 4) of the shell 140 by two screws 152. The upwardly-facing surface 142 of the shell 140 is countersunk at locations corresponding to the screws 152 to avoid any projecting or otherwise obstructing parts. The upwardly and downwardly-facing surfaces 142, 150 of the shell 140 are generally parallel to each other in a region thereof that corresponds to the forehead of a patient lying in a prone position such that the shell 140 has a generally uniform thickness of about 0.125 inches (about 0.3175 centimeters) in this region.

Although, in the illustrated embodiment, the side arms 146, 148 are coupled to the downwardly-facing surface 150 of the shell 140, they may very well be connected to the upwardly-facing surface 142 of the shell 140. Also, it is noted that any suitable fasteners, such as pins, studs, rivets, nut and bolt combinations, and the like, may be used for attaching the side arms 146, 148 to the shell 140. In the illustrated embodiment, the chin pad 144 is integrally formed with the side arms 146, 148. In other embodiments, the chin pad 144 may be separately formed from the side arms 146, 148 and then attached to the side arms 146, 148 by suitable fasteners. Although, in the illustrated embodiment, the chin pad 144 is attached to the shell 140 by two laterally-spaced side arms 146, 148, it is understood that, in other embodiments, the chin pad 144 may be attached to the shell 140 by one arm, instead of two arms, that extends outwardly from the shell 140. In some embodiments, the chin pad 144 and the side arms 146, 148 may be integrally formed with the shell 140. In the illustrated embodiment, the shell 140, the chin pad 144 and the side arms 146, 148 are all molded from a generally rigid radiolucent plastic material, such as polyethylene.

Referring to FIG. 3, the shell 140 has a cutout 160 in a region thereof that generally corresponds to the eyes and nose of a patient lying in a prone position. The cutout 160 opens outwardly through the upwardly and downwardly-facing surfaces 142, 150 of the shell 140. In addition, the cutout 160 opens outwardly through a bottom edge 190 of the shell 140. The cutout 160 has a generally elliptical or oval first portion 164 and a short generally hourglass-shaped second portion 166. The cutout 160 defines a pair of spaced-apart inwardly-projecting tongue portions 168. The second portion 166 of the cutout 160 has a transverse width that varies from broad-to-narrow-to-broad in a direction toward a patient's mouth. The average transverse width of the first portion 164 is greater than the average transverse width of the second portion 166. In the illustrated embodiment, the cutout 160 is integrally molded with the shell 140.

Still referring to FIG. 3, the chin pad 144 and the laterally-spaced side arms 146, 148 define an opening 170 in a region that generally corresponds to the mouth of a patient lying in a prone position. In plan view, as shown, for example, in FIG. 3, the side arms 146, 148 are curved, generally echoing the shape of the chin area of a patient lying in a prone position. The first portion 164 of the cutout 160 is in communication with the opening 170 through the second portion 166 of the cutout 160. The cutout 160 and the opening 170 are configured to allow one or more tubes, such as an endotracheal tube, to be routed therethrough to a patient's nose and/or mouth to provide life support to the patient. As shown in FIG. 2, the side arms 146, 148 are located below the upwardly-facing surface 142 of the shell 140 and below an upwardly-facing surface 172 (FIG. 32) of the chin pad 144 to define a clearance space 156 (FIG. 32) above the side arms 146, 148 through which these tubes may be routed to a patient's nose and/or mouth. Thus, the tubes carrying medical gases may be routed from life support equipment through the clearance space over the side arms 146, 148, then through the cutout 160 and/or the opening 170, to a patient's nose and/or mouth. The C-shaped design of the base 110, positioning the head support 114 above the base 110, positioning of the side arms 146, 148 below the upwardly-facing surface 142 of the shell 140, and the positioning of the cutout 160 and the opening 170 of the head support 114 provide relatively unrestricted access to a patient's airway and allows monitoring of the patient's eyes.

Figure 32:
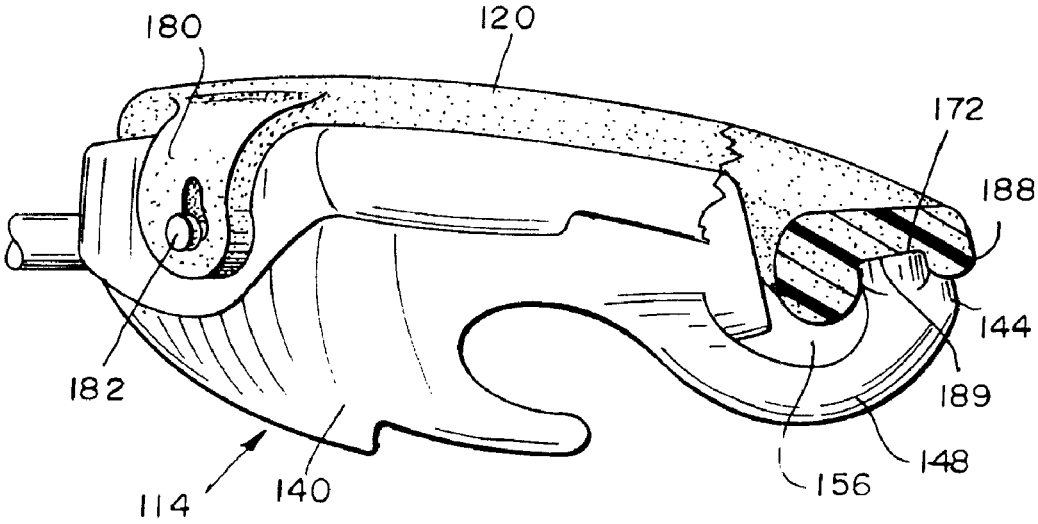
FIG. 32 is a part side view and a part cross sectional view of the contoured foam pad of FIG. 2 showing a tab of the contoured foam pad attached to a downwardly-extending post of the head support and showing a recess on an underside of the contoured foam pad for receiving a chin support of the head support.

As shown in FIGS. 2 and 32, the contoured foam pad 120 has tabs 180 which are secured to posts 182 extending downwardly from the underside of the shell 140. The foam pad 120 has a cutout 178 that generally echoes the cutout 160 and the opening 170 of the head support 114. The upwardly-facing surface 142 of the shell 140 is countersunk at locations corresponding to the posts 182 to avoid any projecting or otherwise obstructing parts. The underside 186 of the foam pad 120 has an oval-shaped ridge 188 defining a recess 189 in a region thereof that corresponds to the chin pad 144 of the head support 114. As shown in FIG. 32, the chin pad 144 is received in the recess 189 when the head support 114 supports the head of a patient lying in a prone position with the foam pad 120 interposed between the shell 140 and the patient's face.

In plan view, as shown, for example, in FIG. 3, the shell 140 generally echoes the shape of the upper portion of the face of a patient lying in a prone position. As used herein, the phrase "upper portion of the face" means the portion of the face above the mouth of the patient. The shell 140 has the split bottom edge 190, a pair of generally parallel laterally-spaced side edges 192 that extend forwardly from the opposite ends of the bottom edge 190, and a curved top edge 194 connecting the forward ends of the side edges 192. As shown, for example, in FIG. 2, the shell 140 has a reinforcing bead 196 along the bottom, side and top edges 190, 192, 194. In a side view, as shown in FIG. 4, the reinforcing bead 196 defines a generally flat horizontal surface.

Figure 4:
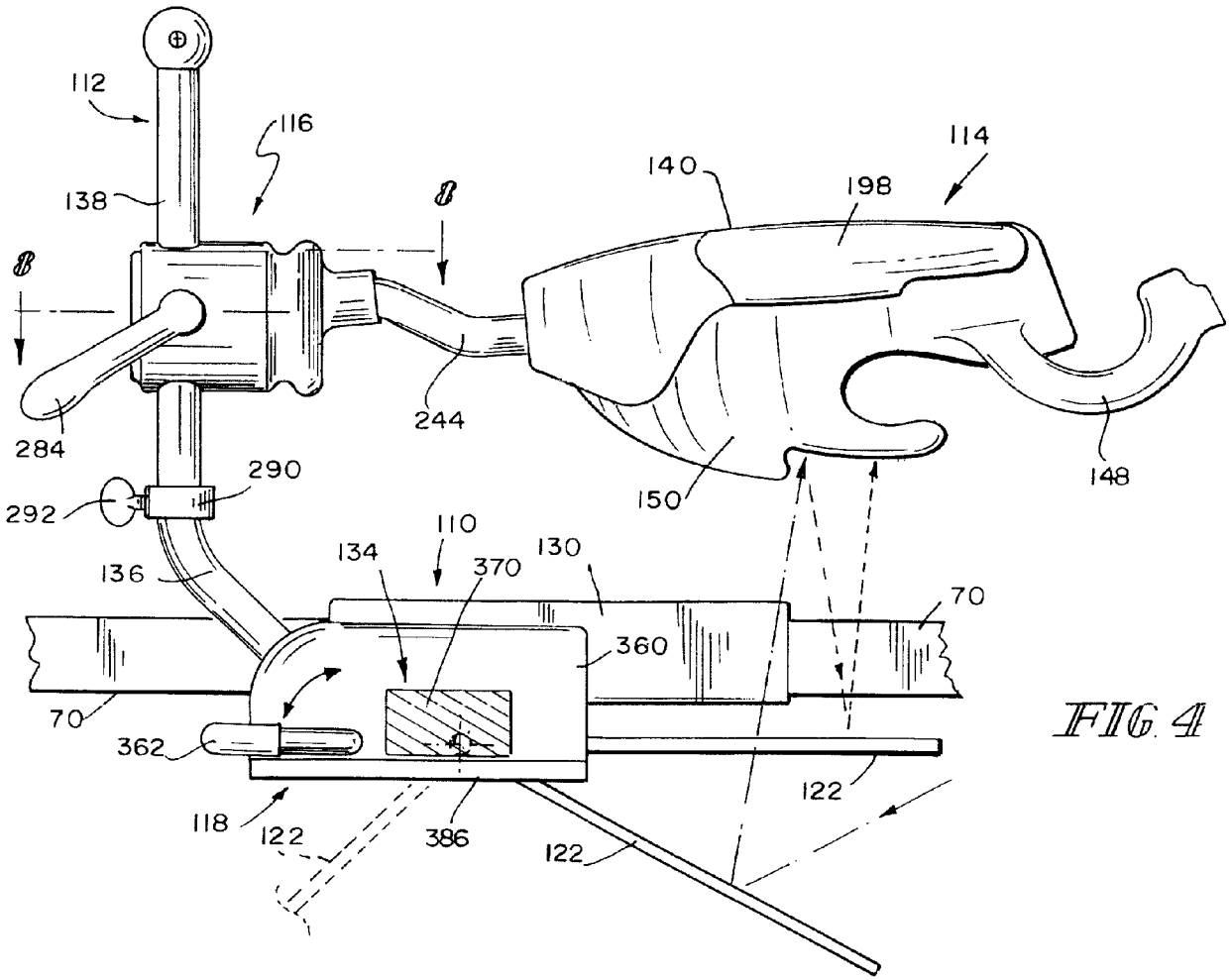
FIG. 4 is a side elevation view of the head support apparatus showing the mirror in a use position (in solid) and in a storage position (in phantom)
Figure 5:
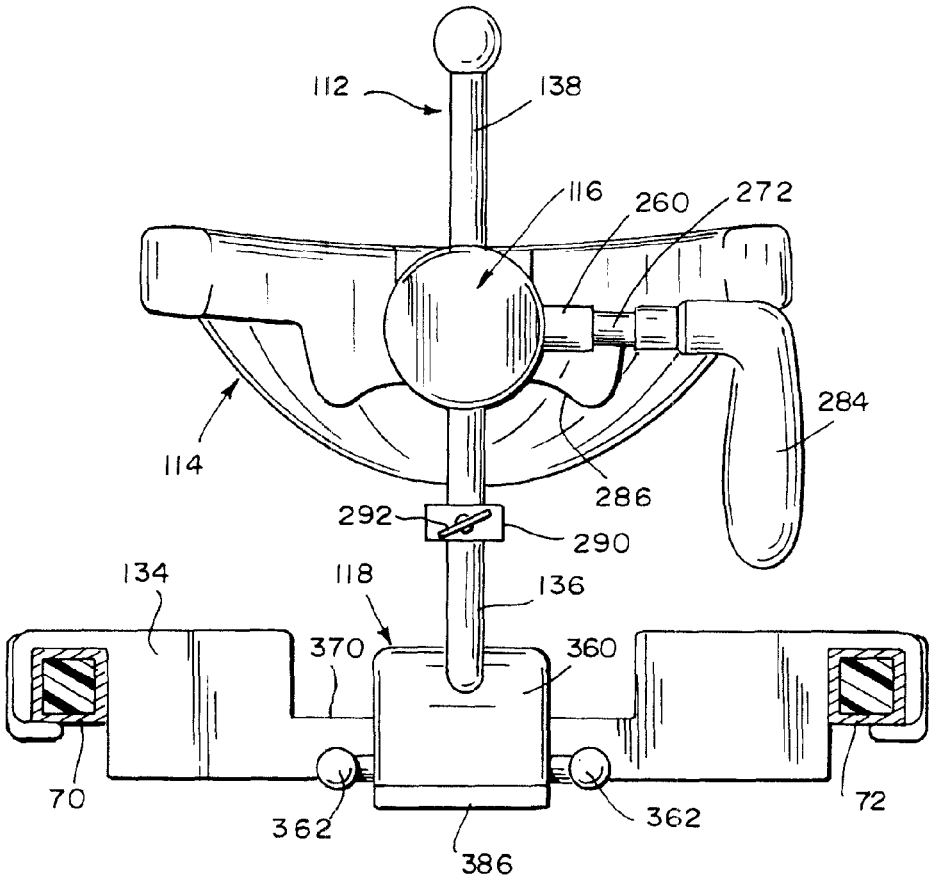
FIG. 5 is an end elevation view of the head support apparatus.

As shown in FIG. 4, the shell 140 has oppositely-disposed reinforcing ribs 198 that extend downwardly from the side edges 192. Each rib 198 has a first portion having a first thickness near the of the curved top edge 194 and a second portion having a second thickness that is smaller than the first thickness and that diminishes somewhat near the bottom edge 190. As shown in FIG. 2, the shell 140 has a mounting block 210 that extends forwardly and downwardly from the curved top edge 194. The block 210 has a longitudinally-extending opening that opens outwardly through a forwardly-facing surface of the block 210.

Figure 8:
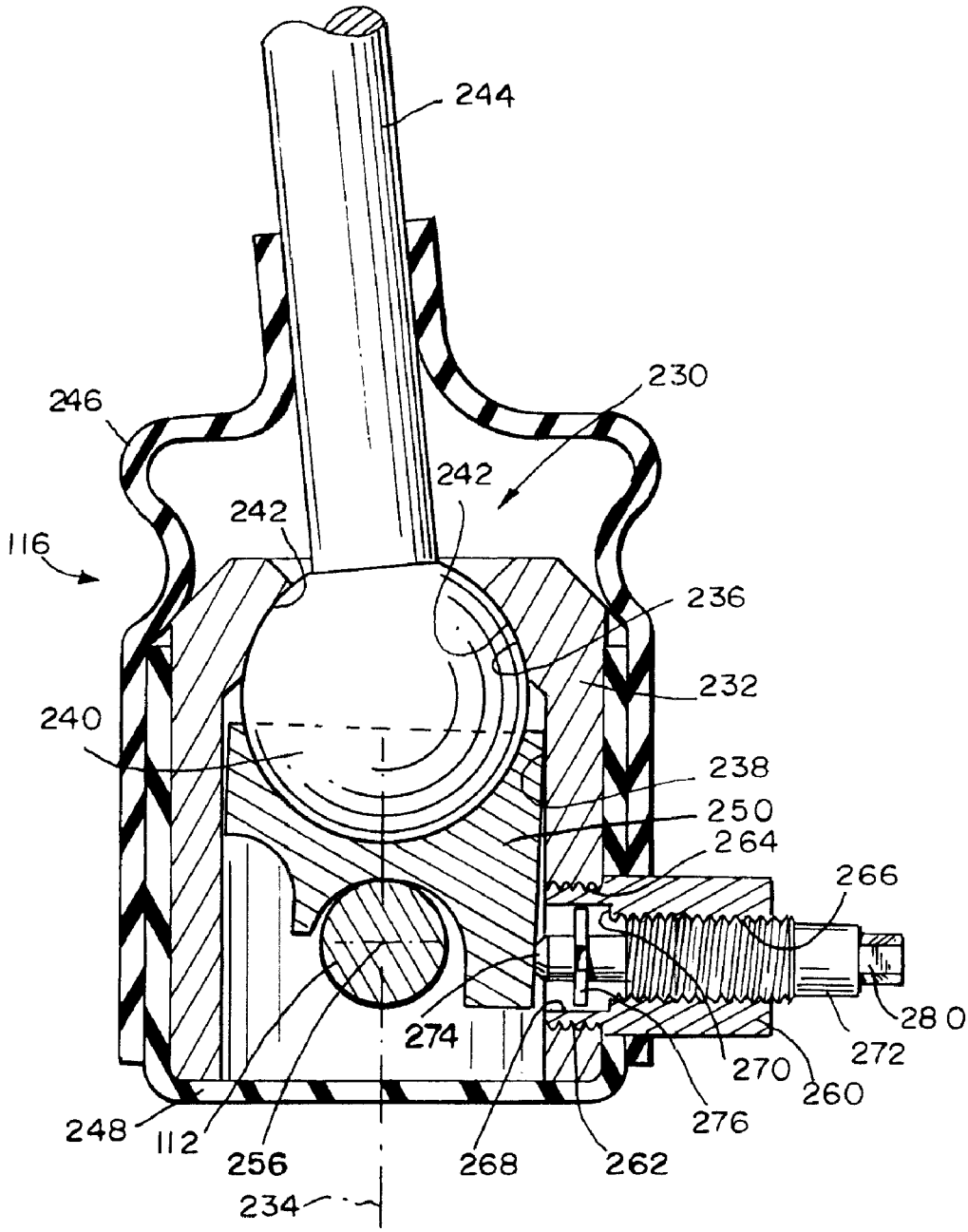
FIG. 8 is a cross sectional plan view of the lockable upper joint.

The lockable upper joint 116 is coupled to the post 112 and coupled to the head support 114. As shown in FIG. 8, the lockable joint 116 comprises a ball joint 230 including a cylindrical housing 232 having a longitudinal axis 234. The housing 232 includes a small diameter bore 236 and a large diameter bore 238. The small diameter bore 234 is sized to hold a ball 240 in place at seat portions 242. The ball 240 is free to simultaneously rotate about a plurality of axes within the confines of the small diameter bore 236. As shown in FIG. 4, a dog-legged support arm 244 extends outwardly from the ball 240 through the small diameter bore 236 in the housing 232. An end portion 246 of the support arm 244 is inserted into the longitudinally-extending opening in the mounting block 210 of the head support 114 and held in place in the opening 212 by two screws. The dog-legged support arm 244 secures the head support 114 to the ball joint 230.

The large diameter bore 238 of the housing 232 is configured to receive an insert 250 which is disposed between the ball 240 and the post 112, which extends vertically upwardly from the base 110. The post 112 extends though oppositely-disposed openings in the housing 232, which define an axis 256 that is disposed generally perpendicularly to the longitudinal axis 234 of the housing 232. The longitudinal axis 234 of the housing 232 extends generally horizontally when the post 112 extending through the openings in the housing 232 extends generally vertically.

Referring to FIGS. 7 and 8, a sleeve 260 having a threaded end portion 262 is threaded into a threaded opening 264 in the housing 232. The sleeve 260 has a small diameter bore 266, a large diameter bore 268, and an annular seat portion 270 formed at the juncture of small and large diameter bores 266, 268. The small diameter bore 266 of the sleeve 260 has internal threads. A stud 272 is threaded into the threaded bore 266 in the sleeve 260 such that a distal end 274 of the stud 272 extends into the housing 232 to engage the insert 250 sandwiched between the ball 240 and the post 112. A collar portion 276 of the stud 272 is configured to engage the seat portion 270 of the sleeve 260 as the stud 272 is threaded out of the sleeve 260, thereby preventing accidental removal of the stud 272 from the sleeve 260.

As the stud 272 is threaded into the housing 232, a force is applied to the insert 250. This force in turn applies a force against both the ball 240 and the post 112 to simultaneously lock both the ball 240 and the post 112 against movement. This locks the longitudinal position of the support arm 244 (and the head support 114 secured thereto) along the post 112, and also locks the angular position of the support arm 244 (and the head support 114 secured thereto) relative to the post 112. The housing 232 is enclosed between first and second covers 246, 248. The covers 246, 248 have holes that line up with the associated holes in the housing 232. In the illustrated embodiment, the covers are made from soft plastic material, such as Vinyl. The lockable joint 116 is of the type disclosed in U.S. Pat. No. 6,622,324, which is hereby incorporated by reference herein.

As shown in FIG. 7, the stud 272 has a hex head 280 which is configured to be received in a hex socket 282 of a removable handle 284. To unlock the ball joint 230, the removable handle 284 is coupled to the stud 272 and turned anticlockwise. To lock the ball joint 230, the handle 284 is turned clockwise. Normally, the handle 284 is detached from the stud 272 and supported by a tether 286 which has its other end secured to the post 112. Detaching the handle 284 from the stud 272 when not in use prevents accidental unlocking of the lockable joint 116 that can, in turn, cause the head support 114 to precipitously drop during surgery. As an added precaution, a lockable stop collar 290 is secured to the vertically-extending portion 138 of the post 112 by a thumb screw 292 just below the lockable joint 116. The vertical position of the stop collar 290 can be adjusted along the post 112.

As shown in FIG. 9, the C-shaped base 110 includes the side portions 130, 132 and the cross portion 134 extending laterally between the side portions 130, 132. Each side portion 130, 132 includes a downwardly-facing channel 310 for receiving an associated siderail 70, 72 of the frame 50. Each siderail 70, 70 has a generally rectangular cross section, and each downwardly-facing channel 310 in the side portion 130, 132 has a complementary generally rectangular cross section. As shown in FIG. 3, the head support apparatus 100 includes clamps 320, 322 for securing the side portions 130, 132 to the respective siderails 70, 72. The clamps 320, 322 are described in detail in U.S. patent application Ser. No. 11/402,331, entitled "Accessory Rail Clamp with Latch and Lock Mechanisms," and filed concurrently herewith, which is hereby incorporated by reference herein.

As shown in FIG. 6, the mirror 122 is coupled to the cross portion 134 by a pair of hinges assemblies 340 for pivoting movement between a storage position (shown in phantom FIG. 4) away from a patient's face and a use position (shown in solid in FIG. 4) adjacent the patient's face. Each hinge assembly 340 has a first portion 342 that is secured by a screw 344 to a downwardly-facing recessed ledge portion 316 (FIG. 9) of the cross portion 134. Each hinge assembly 340 has a second portion 346 that is secured to the mirror 122 by two nut and bolt combinations 348. Each hinge assembly 340 includes a friction mechanism 350 that produces a controlled friction that allows the mirror 122 to rotate when a caregiver applies a rotative force, but that maintains the mirror 122 at a selected angular position when the force is removed.

As noted above, the lockable lower joint 118 is coupled to the base 110 and coupled to the post 112. Referring to FIGS. 6 and 9-11, the lockable joint 118 includes a sliding mounting block 360 coupled to the cross portion 134 of the base 110 for movement along the cross portion 134 and a U-shaped handle 362 coupled to the block 360 and configured to lock the block 360 at a selected lateral position along the cross portion 134. The handle 362 is movable between a locked position shown in FIG. 10 in which the lockable joint 118 is locked and an unlocked position shown in FIG. 11 in which the lockable joint 118 is unlocked.

As shown in FIGS. 6 and 9, the cross portion 134 has a central portion 370 having a first thickness connecting end portions 372 having a second thickness, which is greater than the first thickness. The block 360 includes a downwardly-facing channel 374 for slidably receiving the reduced-thickness central portion 370 of the cross portion 134. The reduced-thickness central portion 370 has a generally rectangular cross-section, and the downwardly-facing channel 374 in the block 360 has a complementary generally rectangular cross-section. The block 360 is movable along the reduced-thickness central portion 370 between inwardly-facing step portions 376 defined at the juncture of the reduced-thickness central portion 370 and the end portions 372. As shown in FIG. 6, the U-shaped handle 362 has a bight portion 380 connecting leg portions 382. The bight portion 380 of the handle 362 is rotatably received in a downwardly-facing slot 384 in the block 360. A cover plate 386 is secured to the block 360 such that the cover plate 386 and the block 360 are disposed on the opposite sides of the reduced-thickness central portion 370 of the base 10 and the bight portion 380 of the handle 362 as shown in FIGS. 10 and 11.

Figure 11:
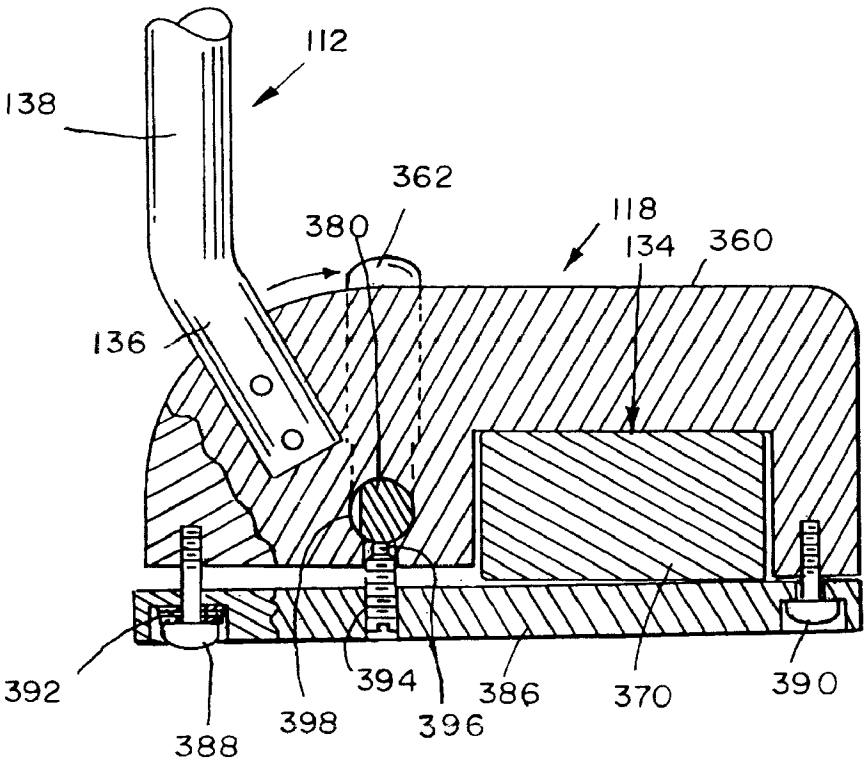
FIGS. 10 and 11 are cross sectional views of the lockable lower joint showing the U-shaped handle in the locked position and unlocked position, respectively.
Figure 10:
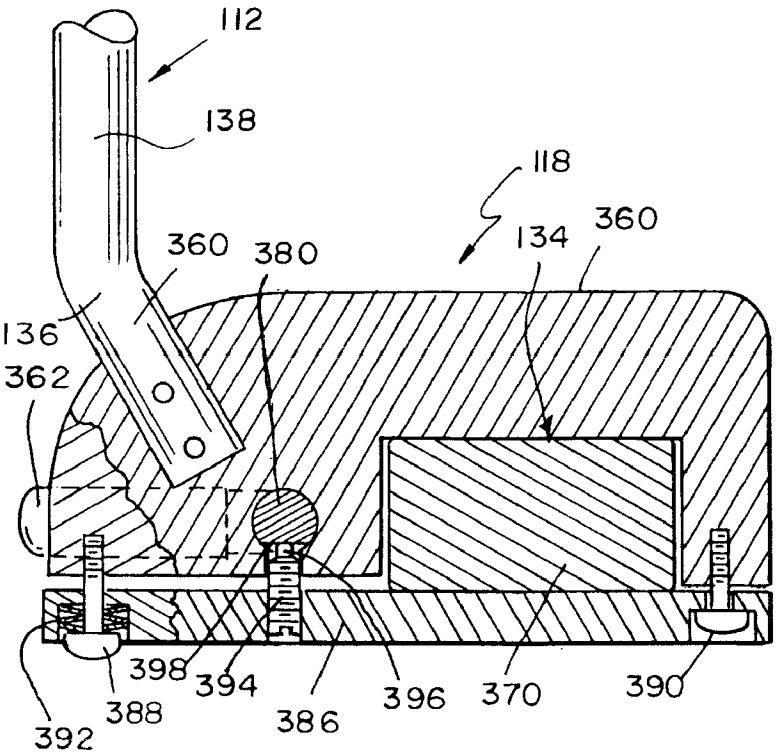

Still referring to FIGS. 10 and 11, the cover plate 386 is secured to the block 360 by a pair of screws 388 near a head end of the block 360 and a screw 390 near a foot end of the block 360. The head end screws 388 extend through slightly oversized openings in the cove plate 386 and are threaded into threaded openings in the block 360. A set of four Belleville washers 392 are inserted between the underside of the cover plate 386 and the head portion of each of the head end screws 388. The foot end screw 390 extends through a slightly oversized opening in the cove plate 386 and is threaded into a threaded opening in the block 360. As shown in FIG. 10, the Belleville washers 392 serve to clamp the sliding block 360 to the reduced-thickness central portion 370 when the U-shaped handle 362 is in the locked position. A set screw 394 is threaded into a threaded opening in the cover plate 386 such that a distal end 396 of the set screw 394 extends through an opening in the block 360 to engage the bight portion 380 of the U-shaped handle 362. The distal end 396 of the set screw 394 engages a flat portion 398 of the bight portion 380 when the handle 362 is in the locked position as shown in FIG. 10. As the U-shaped handle 362 is pivoted from the locked position shown in FIG. 10 to the unlocked position shown in FIG. 11, the bight portion 380 pushes down on the set screw 394 to cause the cover plate 386 to move away from the block 360 to free the block 360 to move sideways along the central cross portion 370 of the base 110.

FIGS. 12-14 shows another embodiment 126 of the contoured foam pad 120. The pad 126 is relatively thin and flat. The pad 126 is interposed between the patient's face and the head support shell 140 during surgery to reduce the risk of injuries to the patient's face. The pad 126 has oppositely-disposed upwardly and downwardly-facing surfaces 400, 402 and a side wall 404 extending therebetween. The upwardly and downwardly-facing surfaces 400, 402 of the pad 126 are generally parallel to each other so that the pad 126 has a generally uniform thickness as shown in FIG. 14. In plan view, the pad 126 generally echoes the shape of a patient's face as shown in FIG. 13. The pad 126 has a cutout 406 in a region thereof that generally corresponds to the eyes, nose and mouth of a patient lying in a prone position. The cutout 406 opens outwardly through the upwardly and downwardly-facing surfaces 400, 402 of the pad 126. A first portion 408 of the cutout 404 has a generally oval shape and a second portion 410 of the cutout has a generally trapezoidal shape. The width of the second portion 410 varies from narrow-to-broad in a direction toward a patient's chin. The average width of the first portion 408 is greater than the average width of the second portion 410.

The pad 126 has oppositely-disposed tabs 412 which extend outwardly from the side wall 404 of the pad 126. In illustrated embodiment, the tabs 412 in the pad 126 have slots 414 for attaching elastic straps or bands. The other ends of the straps are configured to be attached to the underside of the shell 140 by suitable fasteners to secure the pad 126 to the shell 140. In some embodiments, the tabs 414 of the pad 126 are configured to engage complementary tabs (not shown) provided on the shell 140 to properly position the pad 126 with respect to the shell 140. When the head of a patient lying in a prone position is supported by the head support 114 with the pad 126 interposed between the head support 114 and the face of the patient, the cutout 406 in the pad 126 generally aligns with the cutout 160 and the opening 170 in the head support 114. One or more tubes carrying medical gases and/or fluids may be routed from life support equipment through the cutout 160 and the opening 170 in the head support 114, and then through the cutout 406 in the pad 126 to a patient's nose and/or mouth.

Figure 33:
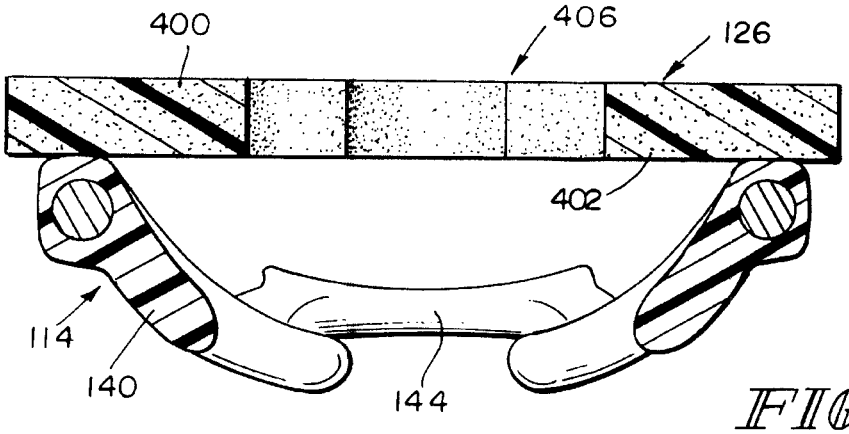
FIGS. 33 and 34 are diagrammatic views showing the foam pad of FIGS. 12-14 before and after it is bent to conform to the interior surface of the head support.
Figure 34:
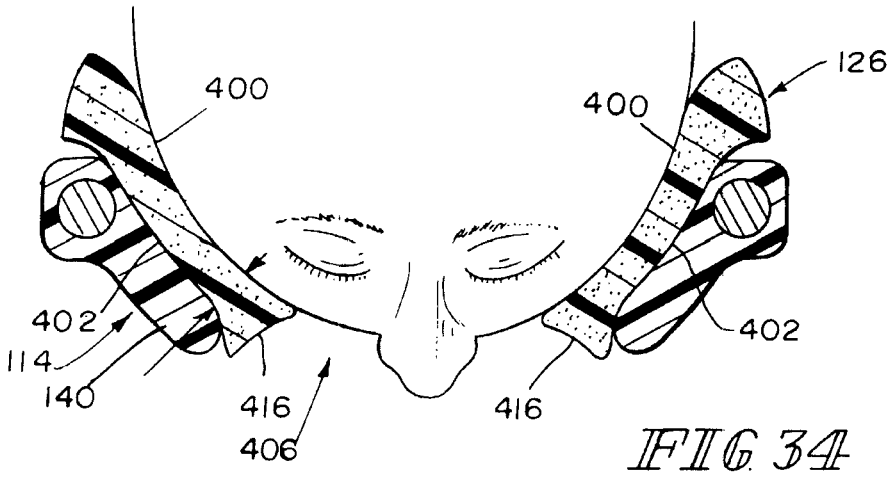

FIGS. 33 and 34 show the pad 126 moving from a flat state (FIG. 33) into a curved state (FIG. 34) as it moves down into the head support shell or cradle 140 under the weight of a patient's head. As best shown in FIG. 34, side walls 416 of the cutout 406 flare outwardly away from the patient's face as the weight of the patient's head causes the downwardly-facing surface 402 of the pad 126 to stretch and bend as it moves down into the head support shell or cradle 140 under the weight of a patient's head. The outward flaring of the side walls 416 away from the patient's face facilitates routing of the tubes carrying medical gases through the cutout 160 and the opening 170 in the head support 114 and through the cutout 406 in the pad 126 to a patient's nose and/or mouth. Also, the outward flaring of the side walls 416 reduces the risk of entangling these tubes during surgery. The cutout 406 in pad 126 to accommodate the patient's eyes, nose and mouth is smaller in its overall dimensions (e.g., width and length) than the cutout 160 in head support 114. As a result, the region of the pad 126 adjacent the periphery of its cutout 406 are not directly supported by head support 114. This tends to reduce forces against the patient in the region adjacent cutout 406, with the forces being concentrated in the areas where head support 114 underlies foam pad, which areas are spaced from the opening defining the shape of cutout 406 of pad 126.

In the illustrated embodiment, the pad 126 has a width of about 11.60 inches (about 29.46 centimeters) and a height of about 13.9 inches (about 35.31 centimeters). The thickness of the pad 126 is about 1.75 inches (about 4.45 centimeters). The first transverse width of the cutout 406 is about 6.0 inches (about 15.24 centimeters). The second transverse width of the cutout 406 varies between about 2.0 inches (about 5.08 centimeters) near the top to about 3.0 inches (about 7.62 centimeters) near the bottom. The slots 414 in the tabs 412 are about 1.25 inches (about 3.18 centimeters) wide. The pad 126 is made from cosmetic foam, such as water-based polyurethane foam. The cosmetic foam material used for the pad 126 is a relatively pliable, easily stretchable soft material that has a relatively low friction surface so that the friction between an upwardly facing surface 400 of the pad 126 and the patient's skin is reduced.

Figure 15:
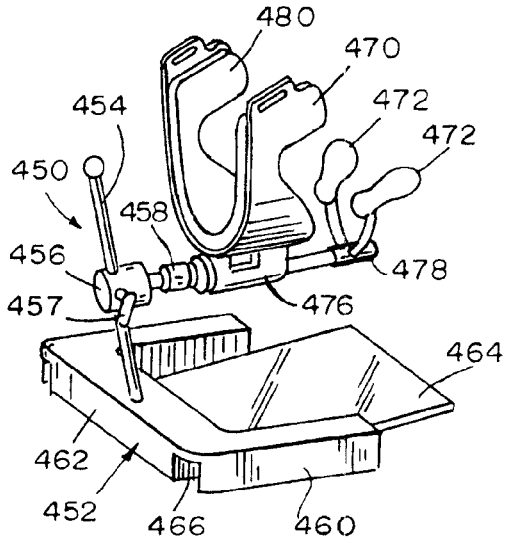
Figure 16:
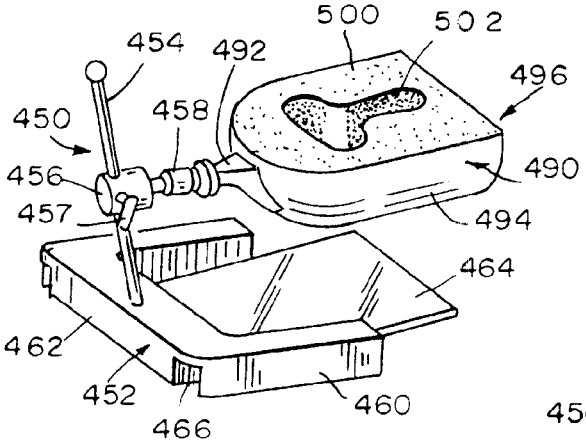
Figure 17:
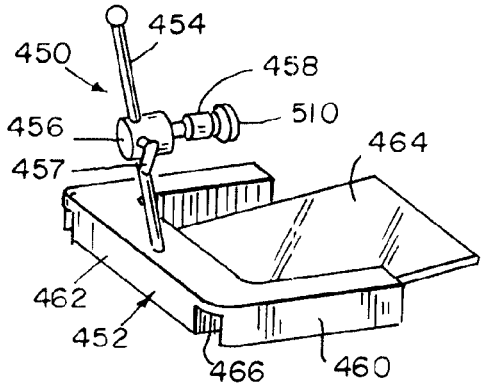
Figure 18:
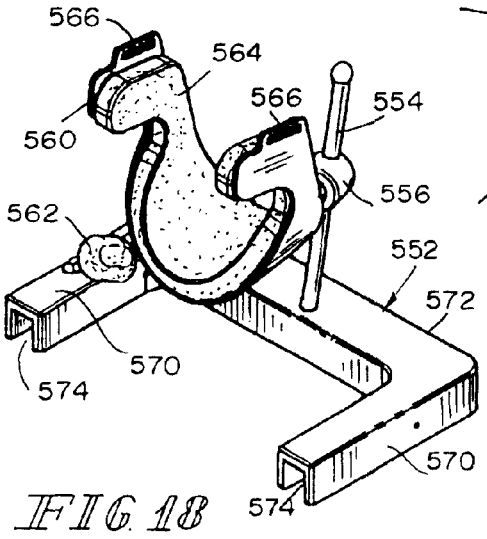
Figure 19:
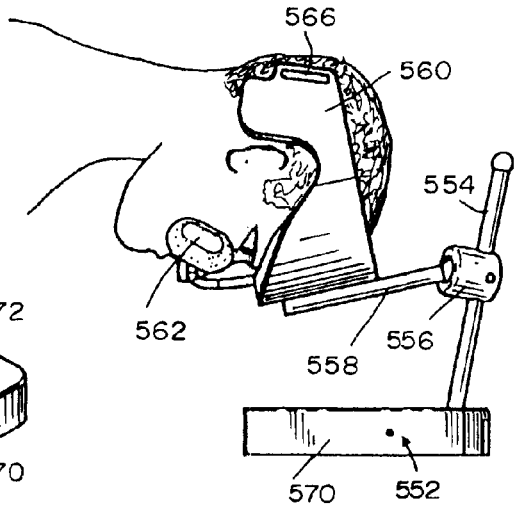
Figure 20:
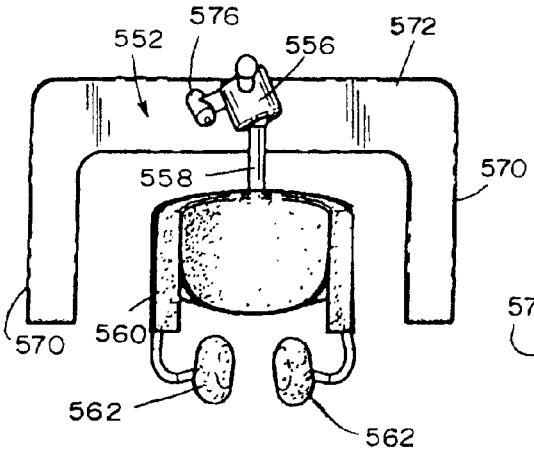
Figure 21:
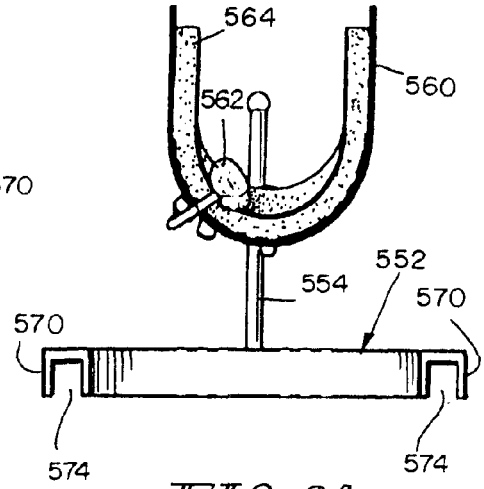
Figure 22:
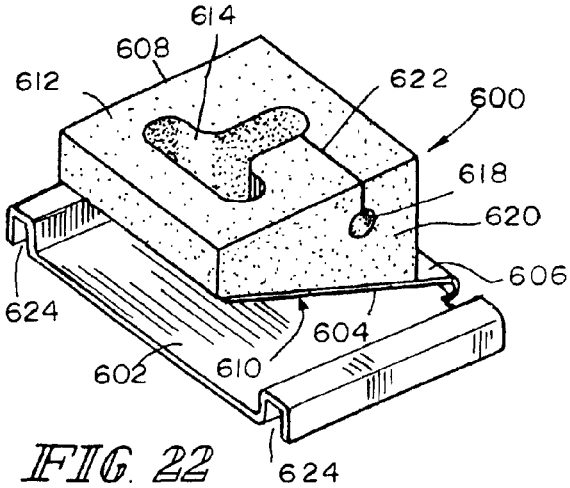
Figure 23:
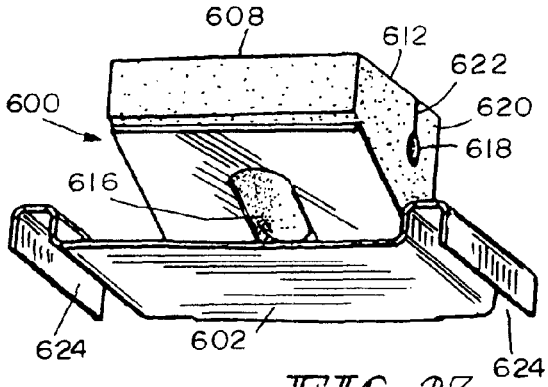
Figure 24:
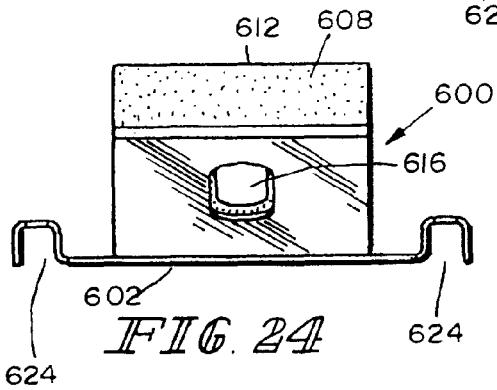
Figure 25:
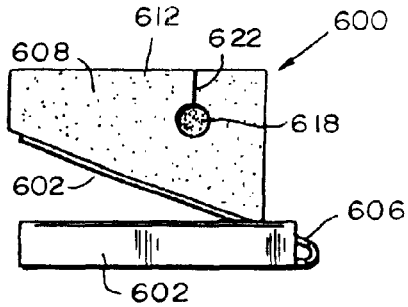

FIGS. 15-31 show other embodiments of the head support apparatus 100. FIGS. 15-17 show a head support apparatus 450 comprising a C-shaped base 452 configured to mount on the frame 50, a post 454 coupled to the base 452 and extending generally upwardly therefrom, and a lockable joint 456 coupled to the post 454 and coupled to a modular coupler 458. The coupler 458 is configured for selective coupling to each of a plurality of head and/or forehead supports, such as Mayfield® tongs, skull clamps, head rings, head holders, horseshoe headrests, and the like. As used herein, the term "head support" is intended to broadly include all head supports including "forehead support." The lockable joint 456 is similar to the lockable joint 116 of the head support apparatus 100.

Illustratively, the base 452 includes a pair of laterally-spaced side portions 460 and a cross portion 462 extending transversely between the side portions 460. A mirror 464 is coupled to the cross portion 462 below the coupler 458 for pivoting movement between use and storage positions. Each of the side portions 460 of the base 452 has a downwardly-opening channel 466 for receiving an associated siderail 70, 72 of the frame 50. The lockable joint 456 includes a handle 457 movable between an unlocked position allowing movement of the coupler 458 about a plurality of axes and a locked position preventing movement of the coupler 458 about the plurality of axes.

In FIG. 15, a forehead support 470 and a pair of cheek supports 472 are coupled to the modular coupler 458 by a support arm 474. In FIG. 16, a head support 490 is coupled to the modular coupler 458 by a support arm 492. In FIG. 17, a Mayfield® adapter 510 is coupled to the modular coupler 458. As shown in FIG. 15, the forehead support 470 and the cheek supports 472 include associated connectors 476, 478. In the illustrated embodiment, the connector 476, when unlocked, allows longitudinal movement of the forehead support 470 along the support arm 474 and allows pivoting movement of the forehead support 470 about the support arm 474. The connector 476, when locked, locks the forehead support 470 at a selected longitudinal position along the support arm 474 and locks the forehead support 470 at a selected angular position relative to the support arm 474.

Likewise, the connector 478, when unlocked, allows longitudinal movement of the cheek supports 472 along the support arm 474 and allows pivoting movement of the cheek supports 472 about the support arm 474. The connector 478, when locked, locks the cheek supports 472 at a selected longitudinal position along the support arm 474 and locks the cheek supports 472 at a selected angular position relative to the support arm 474. To reduce the risk of injuries to the patient's face, a disposable cushion, such as a foam pad 480, is removably secured to an upwardly-facing surface of the forehead support 470.

As noted, the head support 490 is coupled to the modular coupler 458 by the support arm 492. As shown in FIG. 16, the head support 490 comprises a plastic shell 494 having an upwardly-facing generally concave interior surface defining a forwardly and upwardly-opening cavity 496. A foam cushion 500 having a downwardly-facing generally convex exterior surface is received in the cavity 496. The downwardly-facing surface of the foam cushion 500 is configured for cooperative engagement with the upwardly-facing surface of the shell 494. In the embodiment illustrated in FIG. 16, an upwardly-facing surface of the foam cushion 500 is generally flat. In some embodiments, the upwardly-facing surface of the foam cushion 500 may be contoured to provide a comfortable fit to a patient's face.

The foam cushion 500 has a cutout 502 that opens outwardly through the upwardly and downwardly-facing surfaces of the foam cushion 500. Likewise, the shell 494 has a cutout (not shown) that opens outwardly through the upwardly and downwardly-facing surfaces of the shell 494. The cutouts in the foam cushion 500 and the shell 494 are aligned so that one or more tubes carrying medical gases can be routed therethrough to the mouth and/or nose of a patient. In some embodiments, the shell 494 and the foam cushion 500 are both made from transparent material, such as clear polycarbonate material, to improve the visibility of a patient's face. As noted with reference to FIG. 17, the Mayfield® adapter 510 coupled to the modular coupler 458. The Mayfield® adapter 510 is, in turn, couplable to Mayfield® adapter compatible head supports, such as a Mayfield® skull clamp or tongs (not shown), and the like.

FIGS. 18-21 show a head support apparatus 550 comprising a C-shaped base 552 configured to mount on the frame 50, a post 554 coupled to the base 552 and extending generally upwardly therefrom, a lockable joint 556 coupled to the post 554 and having a support arm 558 extending outwardly therefrom, and a forehead support 560 coupled the support arm 558. The lockable joint 556 is similar to the lockable joint 116 of the head support apparatus 100. In the illustrated embodiment, a pair of cheek pads 562 are coupled the forehead support 560. In some embodiments, the cheek pads 562 are removably coupled. In some other embodiments, the cheek pads 562 are independently adjustable. In still other embodiments, the cheek pads 562 are dispensed with. A disposable cushion, such as a foam pad 564, is removably secured to an upwardly-facing surface of the forehead support 560.

In the illustrated embodiment, the base 552 includes a pair of laterally-spaced side portions 570 and a cross portion 572 extending transversely between the side portions 570. Each of the side portions 570 of the base 552 has a downwardly-opening channel 574 for receiving an associated siderail 70, 72 of the frame 50. In some embodiments, a mirror (not shown) is coupled to the cross portion 572 below the forehead support 560 for pivoting movement between use and storage positions. The lockable joint 556 includes a removable quick-release handle 576 (FIG. 20) movable between an unlocked position allowing movement of the forehead support 560 about a plurality of axes and a locked position preventing movement of the forehead support 560 about the plurality of axes. The head support 560 has slots 566 for attaching elastic straps. The other ends of the straps have complementary couplers.

FIGS. 22-25 show a head support apparatus 600 comprising a generally rectangular base 602 configured to mount on the frame 50, an inclined plane 604 coupled to the base 602 and having an upwardly-facing surface 606, and a foam block 608 having a downwardly-facing surface 610. The downwardly-facing surface 610 of the foam block 608 is configured for engagement with the upwardly-facing surface 606 of the inclined plane 604 such that an upwardly-facing surface 612 of the foam block 608 is generally parallel to the base 602. The foam block 608 is removably secured to the inclined plane 604 by suitable fasteners, such as Velcro® strips.

The foam block 608 has a cutout 614 that opens outwardly through the upwardly and downwardly-facing surfaces of the foam block 608. Likewise, the inclined plane 604 has a cutout 616 that opens outwardly through the upwardly and downwardly-facing surfaces of the plane 604. In addition, the foam block 608 has an opening 618 that extends from a side wall 620 of the foam block 608 to the cutout 614 in the foam block 608. One or more tubes carrying medical gases may be routed to a patient's mouth and/or nose through the cutouts 614, 616. Alternately, one or more tubes carrying medical gases may be routed to a patient's mouth and/or nose through the opening 618 in the foam block 608 and then through the cutout 614 in the foam block 608. The opening 618 opens outwardly through the upwardly-facing surface 612 of the foam block 608 through a vertically-extending narrow track 622 so that tubes carrying medical gases can be readily inserted into the opening 618 through the track 622. The base 602 has downwardly-opening channels 624 for receiving siderails 70, 72 of the frame 50 of the spinal surgery extension 20. In some embodiments, the inclined plane 604 and the foam block 608 are both made from transparent material, such as clear polycarbonate material, to improve the visibility of a patient's face.

Figure 26:
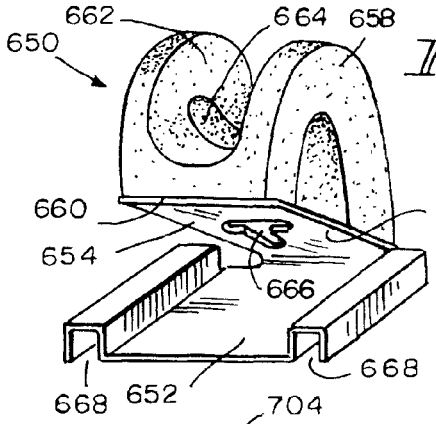
Figure 27:
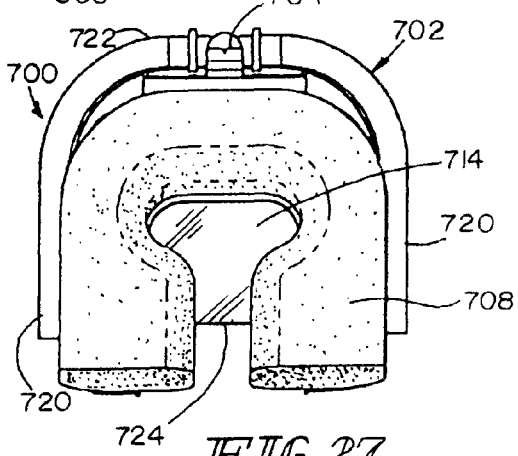
Figure 28:
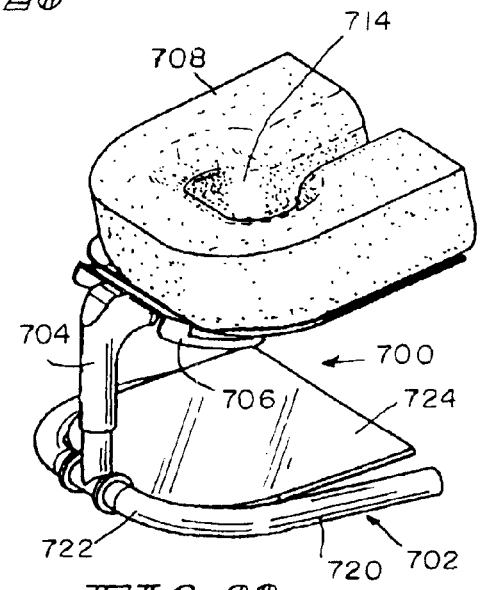
Figure 29:
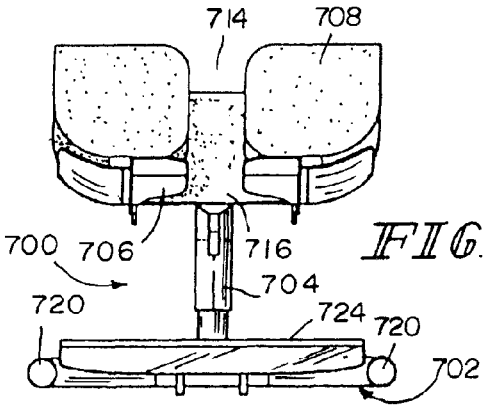

FIG. 26 shows a head support apparatus 650 similar to the head support apparatus 600 of FIGS. 22-25. The apparatus 650 comprises a generally rectangular base 652 configured to mount on the frame 50, an inclined plane 654 having an upwardly-facing surface 656, and a foam block 658 having a downwardly-facing surface 660. The downwardly-facing surface 660 of the foam block 658 is configured for engagement with the upwardly-facing surface 656 of the inclined plane 654. The foam block 658 is removably secured to the inclined plane 654 by suitable fasteners, such as Velcro® strips. Unlike the generally flat upwardly-facing surface 612 of the foam block 608 in FIGS. 22-25, the upwardly-facing surface 662 of the foam block 65 is contoured to accommodate the facial structure of a patient's face.

The foam block 658 has a cutout 664 that opens outwardly through the upwardly and downwardly-facing surfaces of the foam block 658. Likewise, the inclined plane 654 has a cutout 666 that opens outwardly through the upwardly and downwardly-facing surfaces of the plane 654. One or more tubes carrying medical gases may be routed to a patient's mouth and/or nose through the cutouts 664, 666 in the foam block 658 and the inclined plane 654. The base 652 has downwardly-opening channels 668 for receiving siderails 70, 72 of the frame 50 of the spinal surgery extension 20. In some embodiments, the inclined plane 654 and the foam block 658 are both made from transparent material, such as clear polycarbonate material, to improve the visibility of a patient's face.

Figure 30:
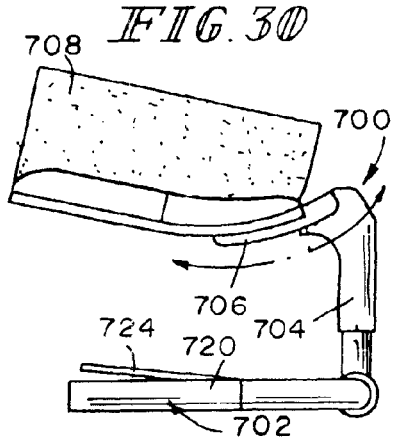

FIGS. 27-30 show a head support apparatus 700 comprising a C-shaped base 702 configured to mount on the frame 50, a vertically adjustable and lockable telescopic post 704 coupled to the base 702 and extending generally upwardly therefrom, a relatively shallow inclined dish 706 coupled to the telescopic post 704, and a horseshoe-shaped foam block 708 coupled the relatively shallow dish 606. The vertical position of the foam block 708 can be adjusted by varying the height of the telescopic post 704. As shown in FIG. 30, a downwardly-facing surface of the foam block 708 is generally convex and a complementary upwardly-facing surface of the inclined dish 706 is generally concave. The generally convex downwardly-facing surface of the foam block 708 is configured for engagement with the generally concave upwardly-facing surface of the inclined dish 706. The foam block 708 is removably secured to the inclined dish 706 by suitable fasteners, such as Velcro® strips.

The foam block 708 has a cutout 714 that opens outwardly through the upwardly and downwardly-facing surfaces of the foam block 708. Likewise, the inclined dish 706 has a cutout 716 (FIG. 29) that opens outwardly through the upwardly and downwardly-facing surfaces of the dish 706. One or more tubes carrying medical gases may be routed to a patient's mouth and/or nose through the cutouts 714, 716 in the foam block 708 and the inclined dish 706. Illustratively, the base 702 includes a pair of laterally-spaced side portions 720 and a cross portion 722 extending transversely between the side portions 720. The side portions 720 of the base 702 are clamped to the associated siderails 70, 72 of the frame 50 by suitable clamps. A mirror 724 is coupled to the cross portion 722 below the foam block 708 for pivoting movement between use and storage positions. In some embodiments, the telescopic post 704 is coupled to the cross portion 722 of the base 702 for pivoting movement about a transverse axis. In some other embodiments, the inclined dish 706 and the foam block 708 are both made from transparent material, such as clear polycarbonate material, to improve the visibility of a patient's face. In still other embodiments, the inclined dish 706 is slidable relative to the telescopic post 704 in a longitudinal direction on suitable tracks (not shown).

Figure 31:
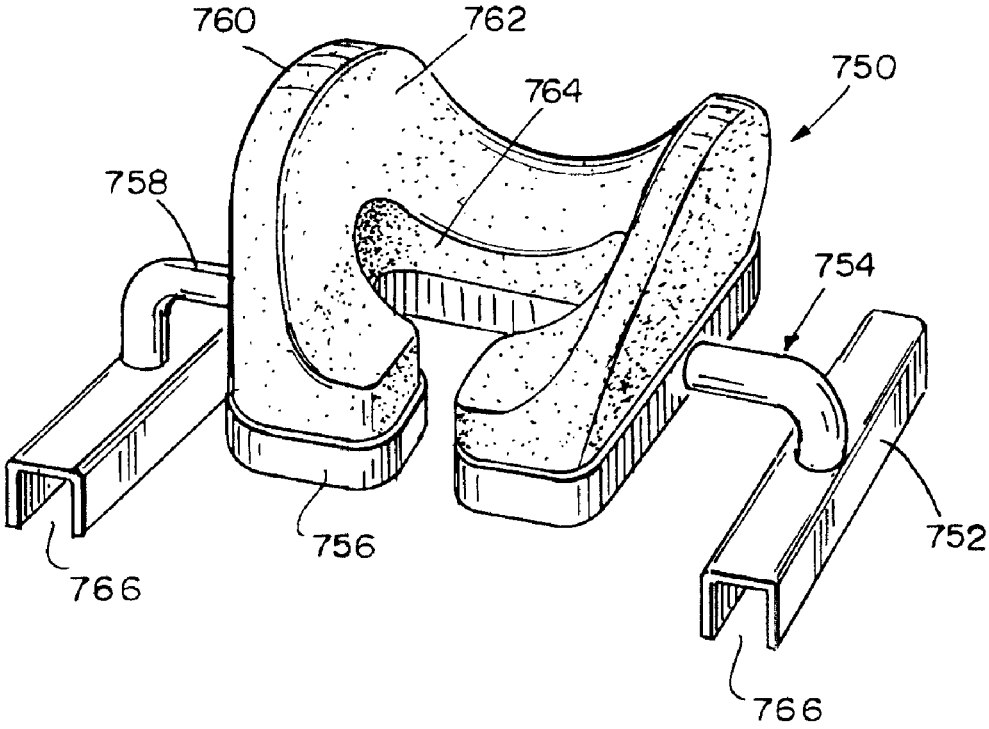

FIG. 31 shows a head support apparatus 750 comprising a base 752 configured to mount on the frame 50, a U-shaped support 754 coupled to the base 702 and extending generally upwardly therefrom, a horseshoe-shaped cradle or shell 756 coupled to a bight portion 758 of the U-shaped support 754 for pivoting movement about a transverse axis, and a horseshoe-shaped foam block 760 received in an upwardly-opening cavity in the shell 756. The upwardly-facing surface 764 of the foam block 760 is contoured to accommodate the facial structure of a patient's face. The foam block 760 has a cutout 766 that opens outwardly through the upwardly and downwardly-facing surfaces of the foam block 760. One or more tubes carrying medical gases may be routed to a patient's mouth and/or nose through the cutout 766 in the foam block 760. In the illustrated embodiment, the base 752 has channels 768 for receiving the associated siderails 70, 72 of the frame 50. In some embodiments, a mirror (not shown) is coupled to the base 702 below the foam block 760 for pivoting movement between use and storage positions. In some embodiments, the shell 756 and the foam block 760 are made from transparent material, such as clear polycarbonate material, to improve the visibility of a patient's face.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

There are a plurality of advantages of the present invention arising from the various features of the embodiments described herein. It will be noted that alternative embodiments of the present invention may not include all of the features described yet still benefit from at least some of the advantages of such features. Those of ordinary skill in the art may readily devise their own implementations of a device that incorporates one or more of the features of the present invention and fall within the spirit and scope of the present invention as defined by the appended claims.

The invention claimed is:

1. An apparatus for attachment to a patient support frame to support a head of a patient lying in a prone position on the frame during surgery, the apparatus comprising:

a base configured to mount on the frame, a post coupled to the base and extending upwardly therefrom, a U-shaped support, a lockable joint received on the post and movable vertically along the post and, the lockable joint coupled to the support, the lockable joint including a handle to move an actuator between a first position wherein the actuator acts on the lockable joint to lock the lockable joint such that the lockable joint does not move relative to the post while simultaneously locking the support such that the support does not move relative to the lockable joint and a second position wherein the lockable joint is free to move along the post and the head support is free to move relative to the lockable joint about a first axis and a second axis, wherein the second axis is not parallel to the first axis, and a foam block coupled to a portion of the U-shaped support for pivoting movement about a transverse axis, the foam block having a cutout in a region thereof corresponding to a patient's eyes, nose and mouth.

2. An apparatus for attachment to a patient support frame to support a head of a patient lying in a prone position on the frame during surgery, the apparatus comprising:

a base configured to mount on the frame, a post coupled to the base and extending upwardly therefrom, a head support for supporting the head of a patient lying in a prone position on the frame, and a lockable first joint received on the post the lockable first joint supporting the head support and movable vertically along the post, the lockable first joint including a first handle to move an actuator between a first position wherein the actuator acts on the lockable first joint to lock the lockable first joint to the post such that the lockable first joint cannot move relative to the post while simultaneously locking the head support such that the head support cannot move relative to the lockable first joint and a second position wherein the lockable first joint is free to move along the post and the head support is free to move relative to the lockable first joint about a first axis and a second axis, wherein the second axis is not parallel to the first axis.

3. The apparatus of claim 2, wherein the lockable first joint includes a housing movable along the post.

4. The apparatus of claim 2, wherein at least the base and the head support are formed of radiolucent material.

5. The apparatus of claim 2, wherein the first handle is removably coupled to the actuator.

6. The apparatus of claim 5, wherein the lockable first joint includes a tether for supporting the first handle when the first handle is not coupled to the actuator.

7. The apparatus of claim 2, wherein the lockable first joint comprises a ball joint.

8. The apparatus of claim 2, wherein the lockable first joint comprises a modular support configured to be coupled to each of a plurality of head supports.

9. The apparatus of claim 2, wherein the base includes a pair of longitudinally-extending and transversely-spaced side portions and a cross portion extending transversely between the side portions.

10. The apparatus of claim 9, wherein the side portions define a space below the head support which is substantially free of any structure that would interfere with the caregiver having relatively unrestricted access to the mouth, the nose and the eyes of a patient lying in a prone position on the frame with the patient's head supported by the head support.

11. The apparatus of claim 9, further comprising a mirror coupled to the cross portion below the head support for movement between a storage position away from a patient's face and a use position adjacent the patient's face.

12. The apparatus of claim 11, comprising a friction mechanism coupled to the mirror and coupled to the cross portion of the base and operable to maintain the mirror at a selected angular position.

13. The apparatus of claim 9, wherein the frame includes a pair of longitudinally-extending and transversely-spaced siderails, and each of the side portions of the base includes a downwardly-opening channel for receiving an associated siderail.

14. The apparatus of claim 13, further comprising at least one clamp coupled to a side portion of the base and operable to secure the side portion to an associated siderail of the frame.

15. The apparatus of claim 13, wherein the siderails have a generally rectangular cross-section, and the downwardly-facing channels in the side portions have a complementary generally rectangular cross-section.

16. The apparatus of claim 9, further comprising a lockable second joint coupled to the cross portion and coupled to the post, wherein the lockable second joint, when locked, prevents lateral movement of the post along the cross portion, and the lockable second joint, when unlocked, allows lateral movement of the post along the cross portion.

17. The apparatus of claim 16, wherein the lockable second joint includes a mounting block having a downwardly-facing channel sized to receive the cross portion and a second handle coupled to the mounting block and configured to lock the mounting block at a selected transverse position along the cross portion.

18. The apparatus of claim 17, wherein the second handle is movable between a first position in which the lockable second joint is locked and a second position in which the lockable second joint is unlocked.

19. The apparatus of claim 1, wherein the head support comprises a shell having an upwardly-facing concave interior surface dimensioned to accommodate the facial structure of a patient resting in a prone position on the frame and a chin support coupled to a pair of laterally-spaced arms that extend outwardly from a downwardly-facing surface of the shell.

20. The apparatus of claim 19, wherein the shell has a cutout in communication with an opening formed by the chin support and the laterally-spaced arms.

21. The apparatus of claim 20, wherein the cutout is in a region that generally corresponds to a patient's eyes and nose, and the opening is in a region that generally corresponds to a patient's mouth.

22. The apparatus of claim 21, wherein the cutout has a generally oval first portion and a short generally hourglass-shaped second portion.

23. The apparatus of claim 19, wherein the cutout and the opening are configured to allow one or more tubes to be routed therethrough to a patient's nose and/or mouth.

24. The apparatus of claim 19, wherein the arms are located below the upwardly-facing surface of the shell to define a space above the arms through which one or more tubes may be routed to a patient's nose and/or mouth.

25. The apparatus of claim 19, wherein the shell is molded from a plastic material, and the cutout is integrally molded therewith.

26. The apparatus of claim 1, wherein the head support comprises a U-shaped forehead support configured to support a patient's forehead.

27. The apparatus of claim 26, wherein the forehead support is coupled to a support arm that extends outwardly from the lockable first joint.

28. The apparatus of claim 27, further comprising a pair of transversely-spaced cheek pads configured to support a patient's cheeks.

29. The apparatus of claim 28, wherein cheek pads are coupled to the support arm.

30. The apparatus of claim 28, wherein the cheek pads are coupled to the forehead support.

31. An apparatus for attachment to a patient support frame to support a head of a patient lying in a prone position on the frame during surgery, the apparatus comprising:

a base configured to mount on the frame, wherein the base includes a pair of longitudinally-extending and transversely-spaced side portions and a cross portion extending transversely between the side portions, a post coupled to the base and extending upwardly therefrom, a head support for supporting the head of a patient lying in a prone position on the frame, a lockable first joint received on the post and movable along the post and supporting the head support, the lockable first joint including a first handle to move an actuator between a first position wherein the actuator acts on the lockable first joint such that the lockable first joint cannot move relative to the post and simultaneously locking the head support such that the head support cannot move relative to the lockable first joint and a second position wherein the lockable first joint is free to move along the post and the head support is free to move relative to the lockable first joint about a plurality of axes, and a lockable second joint coupled to the cross portion and coupled to the post, wherein the lockable second joint, when locked, prevents lateral movement of the post along the cross portion, and the lockable second joint, when unlocked, allowing lateral movement of the post along the cross portion.

32. The apparatus of claim 31, wherein the lockable second joint includes a mounting block having a downwardly-facing channel sized to receive the cross portion and a second handle coupled to the mounting block and configured to lock the mounting block at a selected transverse position along the cross portion.

33. The apparatus of claim 31, wherein the second handle is movable between a first position in which the lockable second joint is locked and a second position in which the lockable second joint is unlocked.

34. The apparatus as defined in claim 31, wherein at least the base and the head support are formed of radiolucent material.

35. The apparatus of claim 34, wherein the lockable joint comprises a ball and a stem coupled to the ball, the head support coupled to the stem such that when the lock is released, the head section is movable relative to the body of the lockable joint in a plurality of directions about the center of the ball.

36. The apparatus of claim 31, wherein the lockable first joint includes a housing movable along the post.

37. The apparatus as defined in claim 36, wherein the first handle is removably coupled to the actuator.

38. The apparatus as defined in claim 37, wherein the lockable first joint includes a tether for supporting the first handle when the handle is not coupled to the actuator.

39. The apparatus of claim 31, wherein the lockable first joint comprises a ball joint.

40. The apparatus of claim 31, wherein the lockable first joint comprises a modular support configured to be coupled to each of a plurality of head supports.

41. The apparatus of claim 31, wherein the side portions define a space below the head support which is substantially free of any structure that would interfere with the caregiver having relatively unrestricted access to the mouth, the nose and the eyes of a patient lying in a prone position on the frame with the patient's head supported by the head support.

42. The apparatus as defined in claim 31, further comprising a mirror coupled to the cross portion below the head support for movement between a storage position away from a patient's face and a use position adjacent the patient's face.

43. The apparatus of claim 42, comprising a friction mechanism coupled to the mirror and coupled to the cross portion of the base and operable to maintain the mirror at a selected angular position.

44. The apparatus of claim 31, wherein the frame includes a pair of longitudinally-extending and transversely-spaced siderails, and each of the side portions of the base includes a downwardly-opening channel for receiving an associated siderail.

45. The apparatus of claim 44, further comprising at least one clamp coupled to a side portion of the base and operable to secure the side portion to an associated siderail of the frame.

46. The apparatus of claim 44, wherein the siderails have a generally rectangular cross-section, and the downwardly-facing channels in side portions have a complementary generally rectangular cross-section.

47. An apparatus for attachment to a patient support frame to support a head of a patient lying in a prone position on the frame during surgery, the apparatus comprising:

a base, a post, a head support, and a lockable joint received on the post, the lockable joint supporting the head support, the lockable joint including (i) a body, (ii) an actuator, (iii) a lock movable relative to the body, and (iv) a single handle acting on the actuator to move the actuator between a first position wherein the actuator causes the lock to act on the post and the head support such that the body cannot move relative to the post and the head support cannot move relative to the body and a second position wherein the body is free to move in two directions along the post and the head support is free to move relative to the body about three non-parallel axes.

* * * * *